US009846448B2

(12) United States Patent
Viet et al.

(10) Patent No.: US 9,846,448 B2
(45) Date of Patent: Dec. 19, 2017

(54) ACCELERATION DEVICE FOR VEHICLE

(71) Applicant: DENSO CORPORATION, Kariya, Aichi-pref. (JP)

(72) Inventors: Pham Van Viet, Nagoya (JP); Takehiro Saito, Anjo (JP); Masahiro Makino, Hanoi (VN)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/578,998

(22) Filed: Dec. 22, 2014

(65) Prior Publication Data

US 2015/0176505 A1 Jun. 25, 2015

(30) Foreign Application Priority Data

Dec. 25, 2013 (JP) ..... 2013-266909

(51) Int. Cl.

| | |
|---|---|
| ***G05G 1/30*** | (2008.04) |
| ***G05G 5/05*** | (2006.01) |
| *F02D 11/02* | (2006.01) |
| *G05G 1/38* | (2008.04) |
| *G05G 1/44* | (2008.04) |

(52) U.S. Cl.

CPC ..... *G05G 5/05* (2013.01); *F02D 11/02* (2013.01); *G05G 1/38* (2013.01); *G05G 1/44* (2013.01); *Y10T 74/2054* (2015.01)

(58) Field of Classification Search

CPC ... G05G 5/05; G05G 1/38; G05G 1/44; F02D 11/02

See application file for complete search history.

(56) References Cited

U.S. PATENT DOCUMENTS 6,003,404 A * 12/1999 Hannewald ..... F02D 11/02 74/512
7,012,423 B2 * 3/2006 Hasegawa ..... G05G 1/38 324/207.25

(Continued)

FOREIGN PATENT DOCUMENTS

JP 2010-003164 1/2010

OTHER PUBLICATIONS

Office Action (2 pages) dated Jan. 28, 2016, issued in corresponding Japanese Application No. 2013-266909 and English translation (2 pages).

*Primary Examiner* — Vicky A. Johnson
(74) *Attorney, Agent, or Firm* — Nixon & Vanderhye P.C.

(57) ABSTRACT

A pedal-side rotating member is composed of a boss portion rotatably supported by a pedal shaft, a spring holding portion for holding one end of a return spring, a stopper arm being operatively in contact with an inner wall surface of a supporting body, and a mechanically-weaker portion, wherein the boss portion, the spring holding portion, the stopper arm and the mechanically-weaker portion are integrally formed as one unit. The spring holding portion is so configured as to be broken away from the boss portion at the mechanically-weaker portion, if an acting force larger than a predetermined value is applied to the stopper arm when the rotating member is rotated in a direction to an acceleration fully-closed position. A broken piece is held at a position inside of the supporting body, so that rotation of the boss portion is not adversely affected by the broken piece.

14 Claims, 13 Drawing Sheets

(56) References Cited

U.S. PATENT DOCUMENTS

| | | | | |
|---|---|---|---|---|
| 2010/0077886 | A1* | 4/2010 | Seiltz | G05G 1/38 74/513 |
| 2012/0297920 | A1* | 11/2012 | Saito | B60K 26/021 74/513 |
| 2014/0096639 | A1 | 4/2014 | Saito et al. | |

* cited by examiner

ACCELERATION DEVICE FOR VEHICLE

CROSS REFERENCE TO RELATED APPLICATION

This application is based on Japanese Patent Application No. 2013-266909 filed on Dec. 25, 2013, the disclosure of which is incorporated herein by reference.

FIELD OF TECHNOLOGY

The present disclosure relates to an acceleration device for an automotive vehicle.

BACKGROUND

An acceleration device is known in the art, according to which an accelerating condition of an automotive vehicle is controlled depending on a stepping amount of an acceleration pedal operated by a vehicle driver. In the known acceleration device, the stepping amount of the acceleration pedal is detected by a rotational angle of a pedal shaft, which is connected to the acceleration pedal. For example, an acceleration device is disclosed in Japanese Patent Application No. 2012-222056 (corresponding to U.S. patent application Ser. No. 14/045,374), which is not published before the filing date (Dec. 25, 2013) of the present application in Japanese Patent Office. The acceleration device of the above patent application has a pedal rotating member, which is fixed to a pedal shaft rotatably supported by a supporting body. A forward end of the pedal rotating member is brought into contact with an inner wall surface of the supporting body in order to limit a fully closed position and/or a fully opened position of the acceleration pedal.

In the acceleration device of the above patent application, the forward end of the pedal rotating member may be broken away from a boss portion of the pedal rotating member, when the forward end of the pedal rotating member is strongly brought into contact with the inner wall surface in a direction to the fully closed position of the acceleration pedal and thereby an excess force is applied to the forward end of the pedal rotating member. When a broken piece of the pedal rotating member (including the forward end thereof), which is a part of the pedal rotating member broken away from the boss portion, is moved inside of the supporting body of the acceleration device and brought into contact with the pedal shaft, a normal rotation of the pedal shaft may be adversely affected. As a result, the acceleration pedal (including the pedal shaft) may not return to the fully closed position thereof.

SUMMARY OF THE DISCLOSURE

The present disclosure is made in view of the above problem. It is an object of the present disclosure to provide an acceleration device, according to which an acceleration pedal as well as a pedal shaft can be surely rotated depending on a stepping amount of the acceleration pedal by a vehicle driver even when a part of a rotating member connected to the pedal shaft and rotatably accommodated in a supporting body is broken away from the rotating member.

According to a feature of the present disclosure, an acceleration device for an automotive vehicle has a supporting body to be fixed to a vehicle body; a pedal shaft rotatably supported by the supporting body; a rotating member provided at a radial-outer side of the pedal shaft and rotatable in accordance with rotation of the pedal shaft; a biasing member for biasing the rotating member in a pedal closing direction; an acceleration pedal to be operated by a vehicle driver; a pedal arm connected at its one end to the acceleration pedal and converting a stepping movement of the acceleration pedal by the vehicle driver into a rotational torque of the pedal shaft; and a rotational angle detecting unit for detecting a rotational angle of the pedal shaft with respect to the supporting body.

The rotating member of the acceleration device is comprised of;

a boss portion formed at the radial-outer side of the pedal shaft;

a biasing-member holding portion extending from the boss portion in a radial-outward direction of the pedal shaft for holding one end of the biasing member; and a mechanically-weaker portion formed between the boss portion and the biasing-member holding portion.

The boss portion, the biasing-member holding portion and the mechanically-weaker portion are integrally formed as one unit. The biasing-member holding portion is so configured to be broken away from the boss portion at the mechanically-weaker portion, when an acting force larger than a predetermined value in the pedal closing direction is applied to the rotating member.

A broken piece, which includes the biasing-member holding portion broken away from the boss portion, is pushed by the biasing member to an inner wall surface of the supporting body. Since the broken piece is prevented by the biasing member from freely moving in an inside of the supporting body, it is possible to avoid a situation that the broken piece is brought into contact with the pedal shaft and thereby the rotation of the pedal shaft is adversely affected. As a result, it is possible to surely convert the stepping movement of the vehicle driver into the rotational torque of the pedal shaft, so that the pedal shaft is surely rotated depending on the stepping movement of the vehicle driver. It is further possible to surely return the acceleration pedal to a fully-closed position thereof.

BRIEF DESCRIPTION OF THE DRAWINGS

The above and other objects, features and advantages of the present disclosure will become more apparent from the following detailed description made with reference to the accompanying drawings. In the drawings:

FIGS. 4A to 4C are schematically enlarged cross sectional views, each showing a portion IV of FIG. 2, wherein FIG. 4C shows a modification of the first embodiment;

FIGS. 5A to 5C are schematically enlarged cross sectional views, each showing a relevant portion of an acceleration device according to a second embodiment of the present disclosure, wherein FIG. 5C shows a modification of the second embodiment;

FIGS. 6A to 6C are schematically enlarged cross sectional views, each showing a relevant portion of an acceleration device according to a third embodiment of the present disclosure, wherein FIG. 6C shows a modification of the third embodiment;

FIGS. 7A to 7C are schematically enlarged cross sectional views, each showing a relevant portion of an acceleration device according to a fourth embodiment of the present disclosure, wherein FIG. 7C shows a modification of the fourth embodiment;

DETAILED DESCRIPTION OF THE EMBODIMENTS

Figure 1:
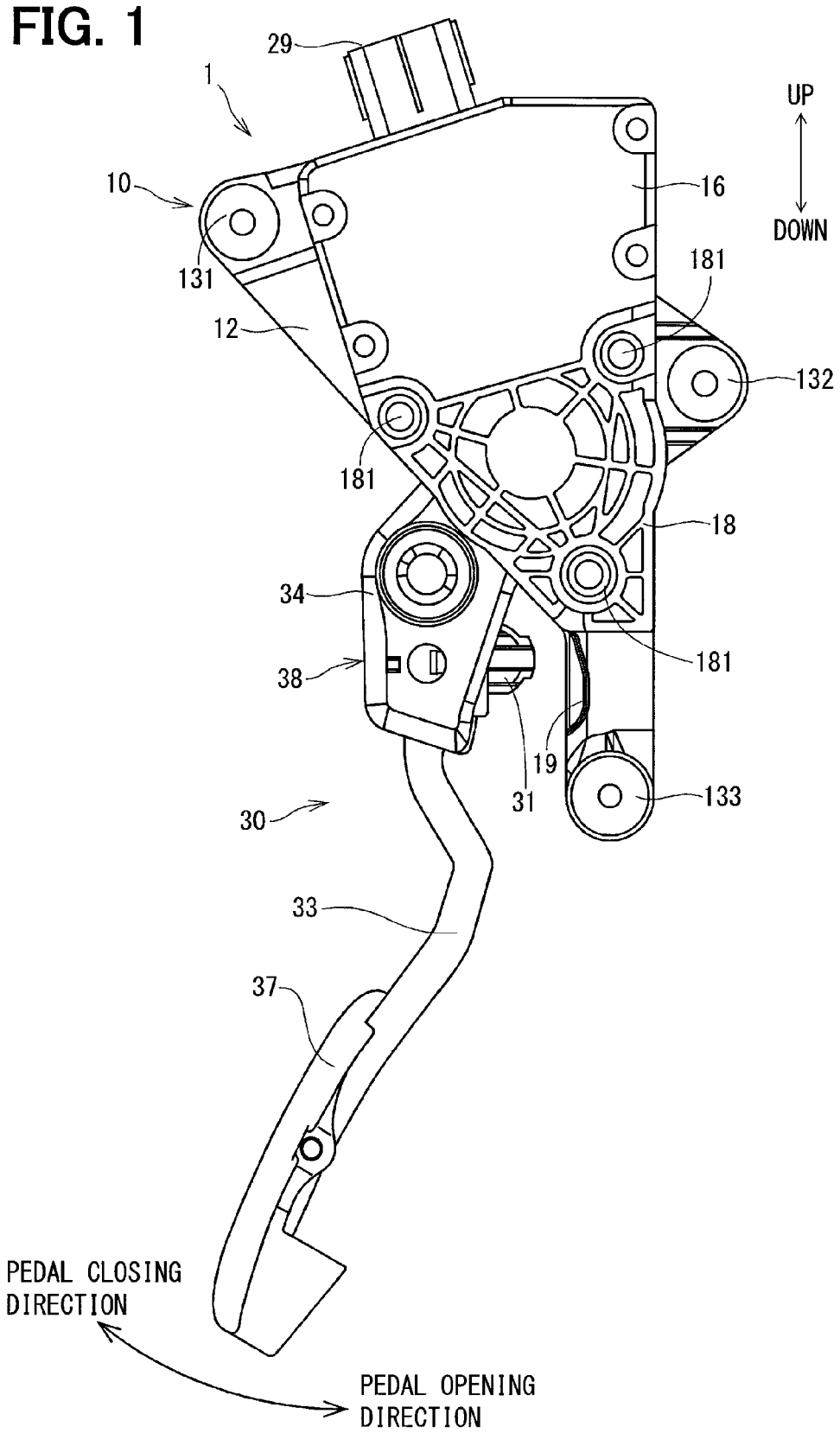
FIG. 1 is a schematic side view showing an acceleration device for a vehicle according to a first embodiment of the present disclosure.
Figure 2:
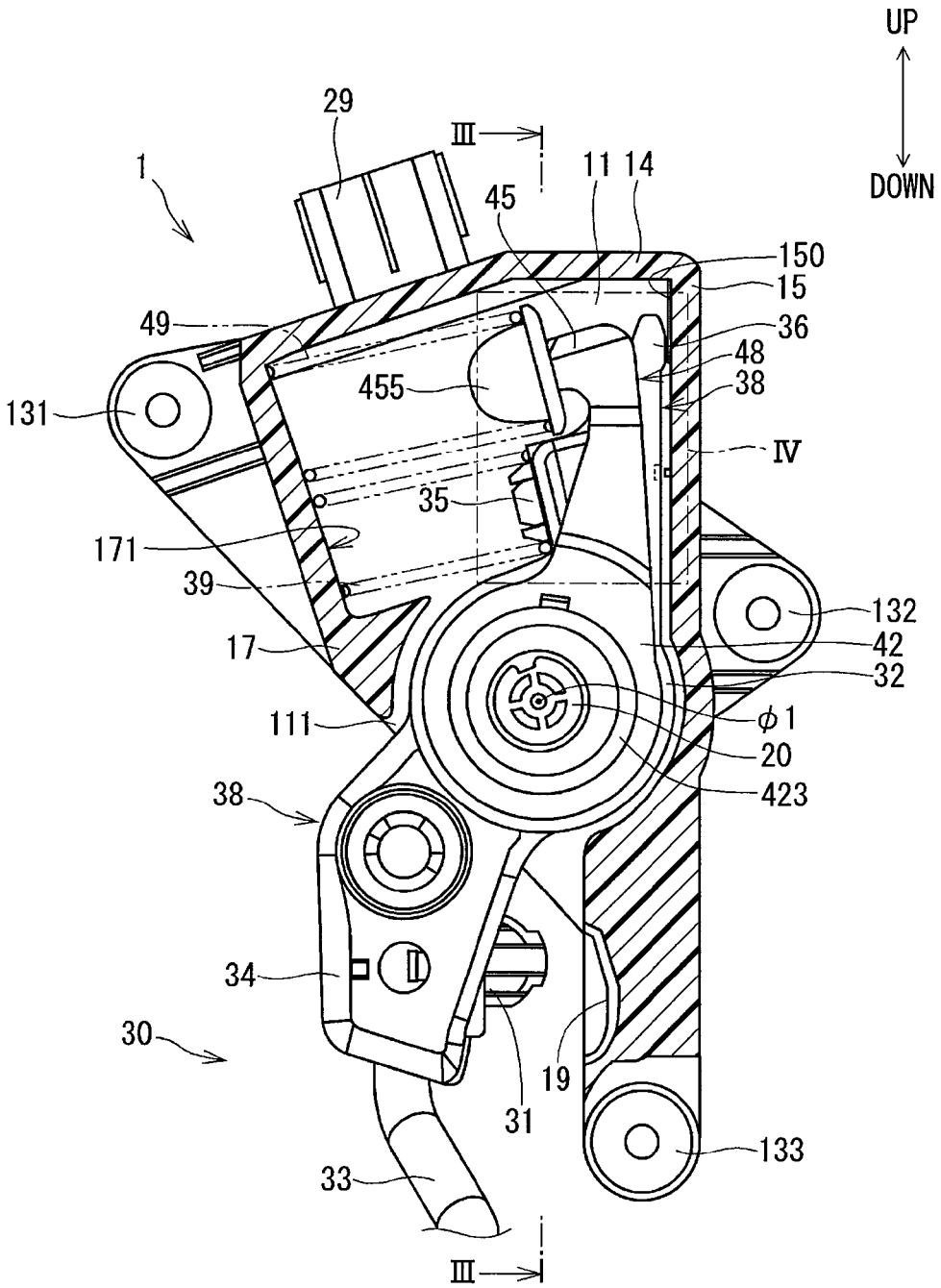
FIG. 2 is a schematic cross sectional view of the acceleration device taken along a line II-II in FIG. 3.

The present disclosure will be explained hereinafter by way of multiple embodiments with reference to the drawings. The same reference numerals are given to the same or similar parts or portions throughout the multiple embodiments for the purpose of avoiding repeated explanation.

First Embodiment

An acceleration device 1 for an automotive vehicle according to a first embodiment of the present disclosure is shown in FIGS. 1 to 4. The acceleration device 1 is an input device, which is operated by a vehicle driver in order to decide a valve opening degree of a throttle valve (not shown) for an internal combustion engine of the automotive vehicle. The acceleration device 1 is of an electronically operated type and outputs an electrical signal representing a stepping stroke amount of an acceleration pedal 37. The electrical signal is transmitted to an outside electronic control unit (not shown). The electronic control unit drives the throttle valve by a throttle actuator (not shown) based on the stepping stroke amount and other vehicle information.

The acceleration device 1 is composed of a supporting body 10, a pedal shaft 20, an operation member 30, the acceleration pedal 37, a return spring 39 (a pedal-side biasing member 39), a rotational angle sensor 25, a hysteresis mechanism 40 and so on. In FIGS. 1 to 4, "UP" is an upper side in a vertical direction, while "DOWN" is a lower side in the vertical direction.

The supporting body 10 is composed of a housing 12, a first cover member 16 and a second cover member 18. The supporting body 10 forms an inner space 11 for accommodating the pedal shaft 20, the return spring 39, the rotational angle sensor 25, the hysteresis mechanism 40 and so on. An opening 111 is formed at a lower portion of the supporting body 10 for communicating the inner space 11 to an outside of the supporting body 10. The opening 111 corresponds to a movable range of the operation member 30, as explained below.

The housing 12 is made of resin and composed of a shaft supporting portion 13 for rotatably supporting one axial end 201 of the pedal shaft 20 (hereinafter, a first axial end 201), a front-side wall portion 17 formed at a front side of the acceleration device 1 and connected to the shaft supporting portion 13, a back-side wall portion 15 formed at a back side of the acceleration device 1, an upper-side wall portion 14 formed at an upper side of the acceleration device 1 and connecting the shaft supporting portion 13 and the front-side wall portion 17 to the back-side wall portion 15, and so on. Outer wall surfaces of the shaft supporting portion 13, the front-side wall portion 17, the back-side wall portion 15 and the upper-side wall portion 14 are formed with patterned indented surfaces. In other words, the outer wall surfaces are formed with net-like concavities and convexities, in order to increase rigidity against external forces applied to the housing 12.

A circular opening, into which the first axial end 201 of the pedal shaft 20 is movably inserted, is formed in the shaft supporting portion 13, so that the pedal shaft 20 is rotatable in the circular opening. In other words, an inner peripheral surface of the circular opening corresponds to a bearing portion 130 for rotatably supporting the first axial end 201 of the pedal shaft 20.

As shown in FIG. 1, multiple fixing portions 131, 132 and 133 are formed in the housing 12. A bolt-hole is formed in each of the fixing portions 131, 132 and 133. The acceleration device 1 is fixed to a vehicle body 8 by multiple bolts (not shown), each of which is inserted through the respective bolt-hole formed in each fixing portion 131, 132 and 133.

A full-open side stopper surface 19 of a recessed shape (hereinafter, a stopper surface 19) is formed at a lower side of the back-side wall portion 15. A full-open side stopper pin 31 of a convex shape (hereinafter, a stopper pin 31) is formed in the operation member 30. When the stopper pin 31 is brought into contact with the stopper surface 19, a rotational movement of the operation member 30 is stopped in an acceleration opening direction (that is, an anti-clockwise direction in FIG. 1 or 2). In other words, when the stopper pin 31 is in contact with the stopper surface 19, the operation member 30 is held at its fully-opened pedal position, which corresponds to an acceleration fully-opened position. The acceleration fully-opened position corresponds to a pedal position, in which opening degree of the acceleration pedal 37 (that is, the stepping stroke amount of the acceleration pedal 37) is 100%.

Figure 3:
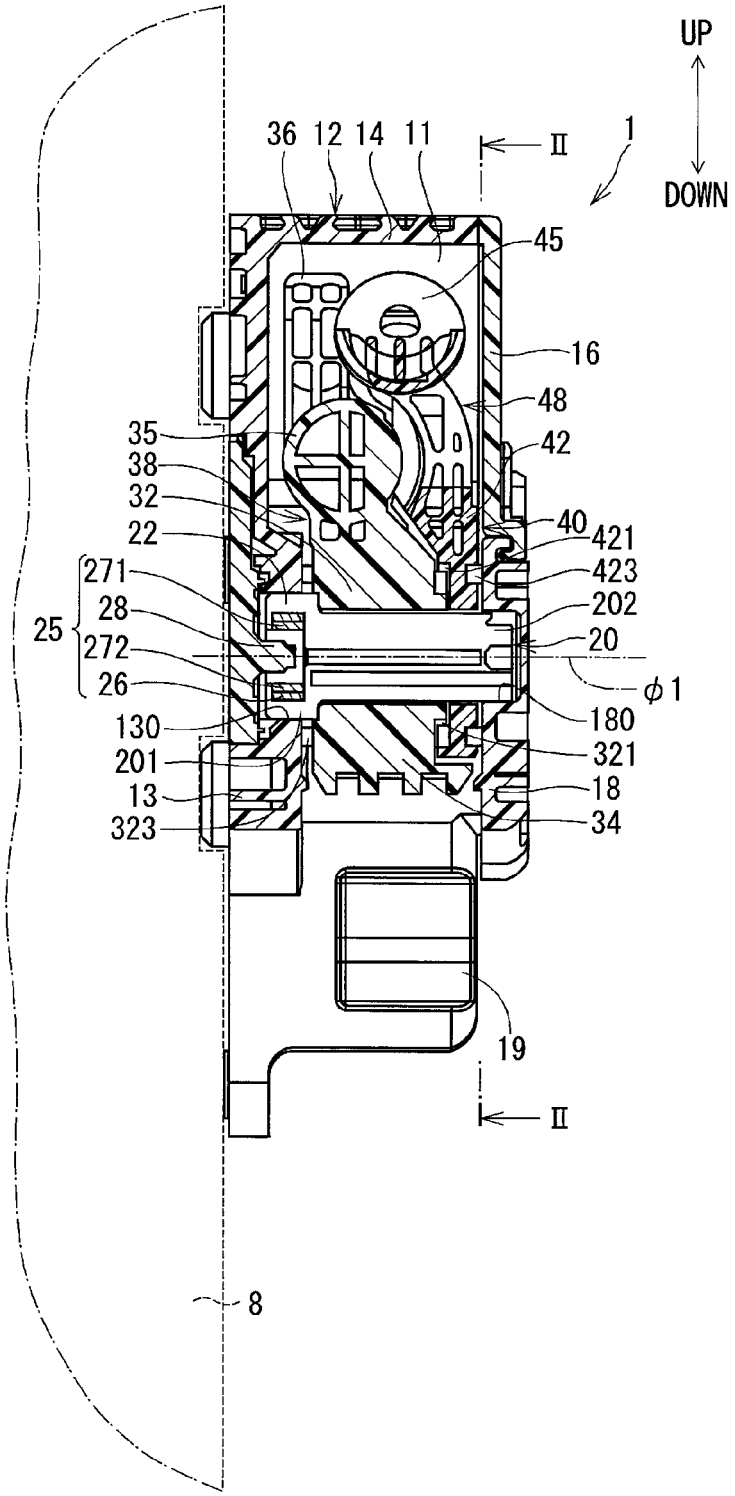
FIG. 3 is a schematic cross sectional view taken along a line in FIG. 2.

Each of the first cover member 16 and the second cover member 18 is fixed to the housing 12 so as to be parallel to the shaft supporting portion 13. The first cover member 16 is formed in an almost rectangular flat plate shape and connected to each axial end of the upper-side wall portion 14, the back-side wall portion 15 and the front-side wall portion 17. In other words, as shown in FIG. 3, the first cover member 16 is connected to each right-hand end of the wall portions 14, 15 and 17, which is located on an opposite side to the shaft supporting portion 13. The first cover member 16 is also connected to the second cover member 18. The first cover member 16 prevents extraneous material from going into the inner space 11 of the acceleration device 1.

The second cover member 18 is formed in a triangular flat plate shape and connected to the housing 12 by multiple bolts 181 at each axial end of the back-side wall portion 15 and the front-side wall portion 17, which is located on the opposite side to the shaft supporting portion 13. A circular recessed portion 180 is formed in an inner wall of the second cover member 18 in order to movably support another axial end 202 of the pedal shaft 20 (hereinafter, a second axial end 202). In other words, an inner peripheral surface of the circular recessed portion corresponds to a bearing portion 180 for rotatably supporting the second axial end 202 of the pedal shaft 20.

An outer wall surface of the second cover member 18 is formed with net-like concavities and convexities, in order to increase rigidity against external forces applied to the second cover member 18. The second cover member 18 also prevents extraneous material from going into the inner space 11 of the acceleration device 1.

The pedal shaft 20 is horizontally arranged in the acceleration device 1, as best shown in FIG. 3. A sensor accommodating space 22 is formed in the first axial end 201 of the pedal shaft 20 for accommodating a detecting portion of the rotational angle sensor 25.

The pedal shaft 20 is rotated depending on a torque inputted from the acceleration pedal 37, which is operated by the vehicle driver. The pedal shaft 20 is rotatable within a predetermined angular range from an acceleration fully-closed position to the acceleration fully-opened position. The acceleration fully-closed position corresponds to a pedal position, in which the opening degree of the acceleration pedal 37 (the stepping stroke amount of the acceleration pedal 37) is 0 (zero) %.

A direction of the rotational movement of the pedal shaft 20 (that is, the rotational movement of the operation member 30) from the acceleration fully-closed position to the acceleration fully-opened position (that is, the rotation in the anti-clockwise direction in FIG. 1 or 2) is referred to as the acceleration opening direction (or a pedal opening direction). On the other hand, a direction of the rotational movement of the pedal shaft 20 from the acceleration fully-opened position to the acceleration fully-closed position (that is, the rotation in a clockwise direction in FIG. 1 or 2) is referred to as an acceleration closing direction (or a pedal closing direction).

The operation member 30 is composed of a pedal-side rotating member 38, the acceleration pedal 37 and a pedal arm 33. The pedal-side rotating member 38 has a pedal-side boss portion 32, an arm connecting portion 34, a pedal-side spring holding portion 35 (a pedal-biasing-member holding portion 35), a full-close side stopper portion 36 and so on, wherein the pedal-side boss portion 32, the arm connecting portion 34, the pedal-side spring holding portion 35 and the full-close side stopper portion 36 are integrally formed as one unit. The full-close side stopper portion 36 is hereinafter referred to as a stopper arm.

The pedal-side boss portion 32 is formed in a tubular shape having a circular cross section and provided between the shaft supporting portion 13 and the second cover member 18. The pedal-side boss portion 32 is fixed to an outer peripheral surface of the pedal shaft 20 by, for example, a press-fit process, so that the pedal shaft 20 is rotated together with the pedal-side rotating member 38.

Multiple helical gear teeth 321 (first gear teeth 321) are integrally formed with the pedal-side boss portion 32 at an axial end surface of the pedal-side boss portion 32 on a side to the second cover member 18 (that is, an axial end surface of the pedal-side boss portion 32 on a right-hand side in FIG. 3 and hereinafter referred to as a second axial end surface). The multiple first gear teeth 321 are formed at equal intervals in a circumferential direction of the pedal-side boss portion 32 of the tubular shape.

Each of the first gear teeth 321 protrudes in an axial direction of the pedal shaft 20 toward a hysteresis-side rotating member 48 of the hysteresis mechanism 40 and a height of each gear tooth 321 in an axial direction of the pedal shaft 20 is increased in the circumferential direction from a pedal-opening-direction side to a pedal-closing-direction side. In other words, each of the gear teeth 321 has an inclined surface, which becomes closer to the hysteresis-side rotating member 48 in the pedal closing direction.

A first friction member 323 is provided at another axial end surface of the pedal-side boss portion 32 on a side to the shaft supporting portion 13 (that is, an axial end surface of the pedal-side boss portion 32 on a left-hand side in FIG. 3 and hereinafter referred to as a first axial end surface). The first friction member 323 is formed in an annular shape. The first friction member 323 is provided between the pedal-side boss portion 32 and an inner wall surface of the housing 12 at a radial-outside position of the pedal shaft 20. When the pedal-side boss portion 32 is pushed in a direction away from the hysteresis-side rotating member 48, that is, in a direction to the shaft supporting portion 13, the pedal-side boss portion 32 is coupled to the first friction member 323 in a friction coupling manner. A frictional force between the pedal-side boss portion 32 and the first friction member 323 works as a rotational resistance of the pedal-side boss portion 32.

One end of the arm connecting portion 34 is connected to a radial-outward peripheral portion of the pedal-side boss portion 32, while the other end of the arm connecting portion 34 outwardly projects to the outside of the supporting body 10 through the opening 111.

The pedal-side spring holding portion 35 is arranged in the inner space 11 and extends from the pedal-side boss portion 32 in a radial-upward direction (that is, a radial-outward direction). The pedal-side spring holding portion 35 holds one end of the return spring 39.

The stopper arm 36 is also arranged in the inner space 11 and further extends from the pedal-side spring holding portion 35 in the radial-upward direction. The stopper arm 36 has a forward end working as a contacting portion. When the contacting portion of the stopper arm 36 is brought into contact with a stopper surface formed by an inner wall surface 150 of the back-side wall portion 15, the rotational movement of the operation member 30 in the pedal closing direction is stopped. Accordingly, the rotational movement of the operation member 30 is limited at the acceleration fully-closed position.

As shown in FIG. 1, one end (an upper end) of the pedal arm 33 is connected to the arm connecting portion 34 of the operation member 30, while the other end (a lower end) extends in a downward direction. In the present embodiment, the pedal arm 33 downwardly extends and is connected to the acceleration pedal 37. A stepping movement of the acceleration pedal 37 by the vehicle driver is converted into the rotational movement of the pedal shaft 20 (the rotation at a center axis $\phi 1$) via the pedal-side rotating member 38 of the operation member 30.

When the acceleration pedal 37 is rotated in the pedal opening direction, a rotational angle of the pedal shaft 20 with respect to the acceleration fully-closed position (an initial position for the rotational movement of the pedal shaft 20) is increased in the pedal opening direction. The opening degree of the acceleration pedal 37 is increased in accordance with the increase of the rotational angle of the pedal shaft 20. On the other hand, when the acceleration pedal 37 is rotated in the pedal closing direction, the rotational angle of the pedal shaft 20 with respect to the initial position is decreased and the opening degree of the acceleration pedal 37 is decreased in accordance with the decrease of the rotational angle of the pedal shaft 20.

The return spring 39 is composed of a coil spring, one end of which is in contact with an inner wall surface 171 of the front-side wall portion 17. The return spring 39 (also referred to as the pedal-side biasing member) biases the operation member 30 in the pedal closing direction. A biasing force applied to the operation member 30 by the return spring 39 becomes larger as the rotational angle of the operation member 30, that is, the rotational angle of the pedal shaft 20, becomes larger in the pedal opening direction. The biasing force is so set that the operation member 30 as well as the pedal shaft 20 is returned to the acceleration fully-closed position (the initial position) independently of a rotational position of the operation member 30.

The rotational angle sensor 25 is composed of a yoke 26, a pair of permanent magnets 271 and 272 magnetized in different directions to each other, a hall element 28 and so on. The yoke 26 is made of magnetic material and formed in a cylindrical shape. The yoke 26 is attached to an inner peripheral wall of the sensor accommodating space 22 of the pedal shaft 20. The magnets 271 and 272 are arranged in an inside of the yoke 26 so as to oppose to each other in a radial direction of the pedal shaft 20 across the center axis $\phi 1$ of the pedal shaft 20. Each of the magnets 271 and 272 is fixed to an inner peripheral wall of the yoke 26. The hall element 28 is arranged at a position between the magnets 271 and 272 in the radial direction of the pedal shaft 20. The rotational angle sensor 25 is also referred to as a rotational angle detecting unit.

Voltage is generated at the hall element 28 when magnetic field is applied to the hall element 28, in which electric current flows. Density of magnetic flux passing through the hall element 28 is changed when the magnets 271 and 272 are rotated together with the pedal shaft 20 around the center axis $\phi 1$ of the pedal shaft 20. Amplitude of the generated voltage is in proportion to the density of the magnetic flux passing through the hall element 28. The rotational angle sensor 25 detects the voltage generated at the hall element 28 in order to detect a relative rotational angle between the hall elements 28 and the magnets 271 and 272, namely the rotational angle of the pedal shaft 20 with respect to the supporting body 10. The rotational angle sensor 25 outputs an electric signal, which represents the detected rotational angle. The electric signal is transmitted to the outside electronic control unit (not shown), which is provided above the acceleration device 1, via an outside connector 29.

The hysteresis mechanism 40 is composed of the hysteresis-side rotating member 48, a second friction member 423, a hysteresis spring 49 and so on. The hysteresis-side rotating member 48 has a hysteresis-side boss portion 42, a spring holding portion 45 (a hysteresis-side spring holding portion 45) and so on, wherein the hysteresis-side boss portion 42 and the hysteresis-side spring holding portion 45 are integrally formed as one unit.

The hysteresis-side boss portion 42 is provided between the pedal-side boss portion 32 and an inner wall surface of the second cover member 18 and at the radial-outside position of the pedal shaft 20. The hysteresis-side boss portion 42 is formed in an annular shape and rotatable relative to the pedal shaft 20 and the pedal-side boss portion 32. In addition, the hysteresis-side boss portion 42 is movable in the axial direction of the pedal shaft 20 with respect to the pedal-side boss portion 32, so that the hysteresis-side boss portion 42 is moved closer to or more separated from the pedal-side boss portion 32. Multiple second helical gear teeth 421 are integrally formed with the hysteresis-side boss portion 42 on an axial side surface thereof facing to the pedal-side boss portion 32. The multiple second gear teeth 421 are formed at equal intervals in the circumferential direction of the hysteresis-side boss portion 42 of the annular shape.

Each of the second gear teeth 421 protrudes in the axial direction of the pedal shaft 20 toward the pedal-side boss portion 32 and a height of each gear tooth 421 in the axial direction of the pedal shaft 20 is increased in the circumferential direction from a pedal-closing-direction side to a pedal-opening-direction side. In other words, each of the gear teeth 421 has an inclined surface, which becomes closer to the pedal-side boss portion 32 in the pedal opening direction.

The first helical gear teeth 321 and the second helical gear teeth 421 are engaged with each other in the circumferential direction of the pedal shaft 20. In other words, since the inclined surfaces of the first helical gear teeth 321 and the inclined surfaces of the second helical gear teeth 421 are brought into contact with each other, the rotational force can be transmitted from the pedal-side boss portion 32 to the hysteresis-side boss portion 42, or vice versa. More exactly, the rotation of the pedal-side boss portion 32 in the pedal opening direction is transmitted to the hysteresis-side boss portion 42 via the first helical gear teeth 321 and the second helical gear teeth 421. On the other hand, the rotation of the hysteresis-side boss portion 42 in the pedal closing direction is transmitted to the pedal-side boss portion 32 via the second helical gear teeth 421 and the first helical gear teeth 321.

When the pedal-side boss portion 32 is located not in the acceleration fully-closed position (that is, not in the initial position) but at such a rotational position, which is on a side toward the acceleration fully-opened position, the inclined surfaces of the first and second helical gear teeth 321 and 421 are engaged with each other and the pedal-side boss portion 32 and the hysteresis-side boss portion 42 are pushed by each other in the axial direction of the pedal shaft 20 away from each other. A pushing force of the first helical gear teeth 321 for pushing the pedal-side boss portion 32 toward the shaft supporting portion 13 becomes larger, when the rotational angle of the pedal-side boss portion 32 is increased in the acceleration opening direction from the acceleration fully-closed position. In a similar manner, a pushing force of the second helical gear teeth 421 for pushing the hysteresis-side boss portion 42 toward the second cover member 18 becomes larger, when the rotational angle of the hysteresis-side boss portion 42 is increased in the acceleration opening direction from the acceleration fully-closed position.

The hysteresis-side spring holding portion 45 is arranged in the inner space 11 and extends from the hysteresis-side boss portion 42 in the radial-upward direction. A spring supporting member 455 for supporting one end of the hysteresis spring 49 is provided at a forward end of the hysteresis-side spring holding portion 45. The forward end of the hysteresis-side spring holding portion 45 is formed in a semi-spherical shape and a recessed portion of the spring supporting member 455 is also formed by a semi-spherical surface. Since the spring supporting member 455 is in contact with the forward end of the hysteresis-side spring holding portion 45 via the semi-spherical surfaces, a biasing force of the hysteresis spring 49 is transmitted to the hysteresis-side spring holding portion 45 without being influenced by an angular position of the hysteresis spring 49 with respect to the hysteresis-side spring holding portion 45.

The second friction member 423 is formed in an annular shape and provided between the hysteresis-side rotating member 48 and the inner wall surface of the second cover member 18 at a radial-outside position of the pedal shaft 20. When the hysteresis-side rotating member 48 is pushed in the axial direction away from the pedal-side boss portion 32, that is, in the direction to the second cover member 18, the hysteresis-side rotating member 48 is coupled to the second friction member 423 in the friction coupling manner. A frictional force, which is generated between the hysteresis-side rotating member 48 and the second friction member 423, works as a rotational resistance of the hysteresis-side rotating member 48.

The hysteresis spring 49 is composed of a coil spring, one end of which is supported by the spring supporting member 455 and the other end of which is in contact with the inner wall surface 171 of the front-side wall portion 17. The hysteresis spring 49 biases the hysteresis-side boss portion 42 in the pedal closing direction. A biasing force of the hysteresis spring 49 becomes larger as the rotational angle of the hysteresis-side boss portion 42 becomes larger in the pedal opening direction. A torque applied to the hysteresis-side boss portion 42 by the biasing force of the hysteresis spring 49 is transmitted to the pedal-side boss portion 32 via the second helical gear teeth 421 and the first helical gear teeth 321.

Figure 4A:
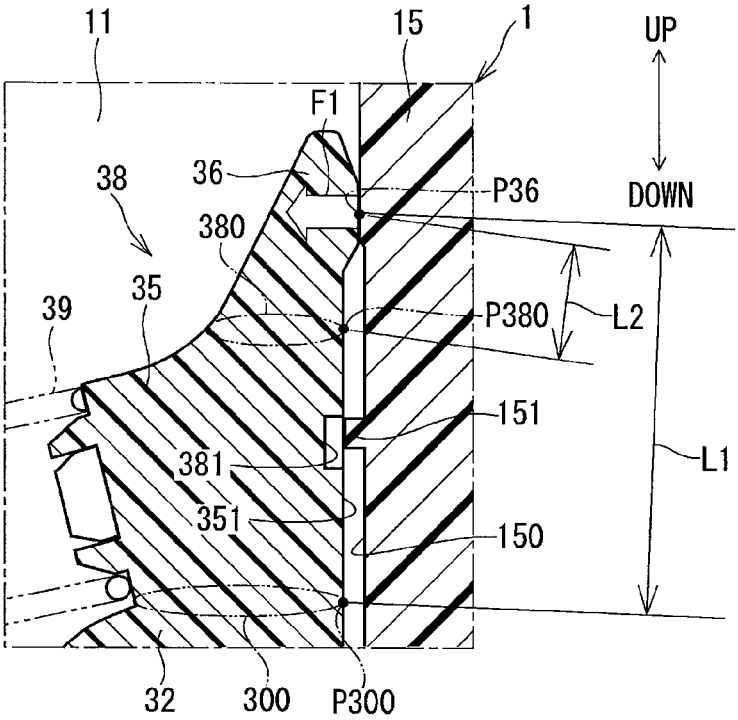
Figure 4B:
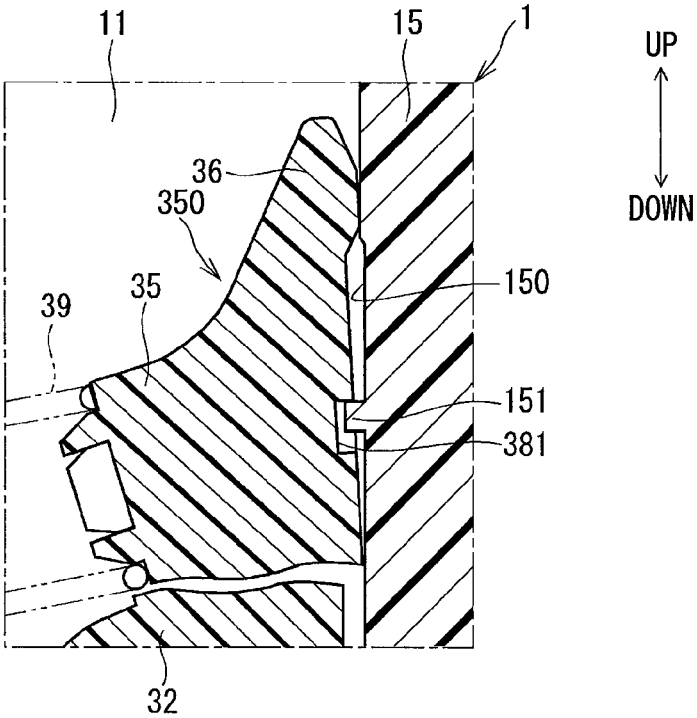

In the acceleration device 1 of the present embodiment, the pedal-side spring holding portion 35 is connected to the pedal-side boss portion 32 via a mechanically-weaker portion 300. A structure and/or configuration of the pedal-side rotating member 38 will be explained more in detail with reference to FIGS. 4A and 4B. Each of FIGS. 4A and 4B is a schematically enlarged cross sectional view showing a portion IV of FIG. 2. Namely, each of FIGS. 4A and 4B shows a cross sectional view of a relevant portion of the pedal-side rotating member 38.

The mechanically-weaker portion 300 is formed between the pedal-side boss portion 32 and the stopper arm 36 as a portion, which is mechanically weaker than other portions of the pedal-side rotating member 38.

More exactly, the mechanically-weaker portion 300, which is indicated by a two-dot-chain line in FIG. 4A, is so made as to satisfy the following expression 1:

$$Z1<Z2\times(L1/L2) \quad \text{(expression 1)}$$

In the above expression 1;

Z1 is a modulus of section of the mechanically-weaker portion 300;

Z2 is a modulus of section of any arbitrary portion 380, which is any portion of the pedal-side rotating member 38 between the mechanically-weaker portion 300 and the stopper arm 36, for example, a portion indicated by another two-dot-chain line in FIG. 4A;

L1 is a distance between a contacting point P36 and a mechanically weak point P300, wherein the contacting point P36 corresponds to a point of the stopper arm 36 to be in contact with the inner wall surface 150 of the back-side wall portion 15 and the mechanically weak point P300 corresponds to a point of the mechanically-weaker portion 300 facing to the inner wall surface 150; and L2 is a distance between the contacting point P36 and an arbitrary point P380, wherein the arbitrary point P380 corresponds to a point of the arbitrary portion 380 facing to the inner wall surface 150 of the back-side wall portion 15.

A recessed portion 381 is formed in the pedal-side spring holding portion 35 at its back-side surface 351 facing to the inner wall surface 150 of the back-side wall portion 15. A projection 151, which is configured to be engaged with the recessed portion 381, is formed in the back-side wall portion 15 at the inner wall surface 150 thereof facing to the recessed portion 381. The recessed portion 381 is also referred to as a second recessed portion and the projection 151 is also referred to as a first projection.

An operation of the acceleration device 1 will be explained. When the acceleration pedal 37 is stepped on, the operation member 30 is rotated together with the pedal shaft 20 around the center axis $\phi 1$ of the pedal shaft 20 in the pedal opening direction, depending on a stepping force applied to the acceleration pedal 37. In this operation, the stepping force is necessary to generate such a torque, which is larger than a sum of a torque of the biasing force of the return spring 39, a torque of the biasing force of the hysteresis spring 49, and a torque of the resistance force generated by the friction force of the first friction member 323 and the second friction member 423.

When the acceleration pedal 37 is maintained at any pedal position after the acceleration pedal 37 is stepped forward, it is necessary that the stepping force generates such a torque which is larger than a difference between the torque of the biasing force of the return spring 39 and the hysteresis spring 49 and the torque of resistance force generated by the friction force of the first friction member 323 and the second friction member 423. In other words, the vehicle driver may decrease the stepping force by a certain amount after the acceleration pedal 37 has been stepped forward, when the vehicle driver maintains such a stepped-forward pedal position of the acceleration pedal 37.

When the torque generated by the stepping force becomes such a value, which is smaller than the difference between the torque of the biasing force of the return spring 39 and the hysteresis spring 49 and the torque of resistance force generated by the friction force of the first friction member 323 and the second friction member 423, the rotational position of the acceleration pedal 37 is moved in a direction to its acceleration fully-closed position (the initial position). In this operation, it is sufficient for the vehicle driver to stop his stepping-forward motion in a case of quickly returning the acceleration pedal 37 to the acceleration fully-closed position. Therefore, it does not place an additional burden on the vehicle driver. On the other hand, in a case that the acceleration pedal 37 is gradually returned to the acceleration fully-closed position, it is necessary for the vehicle driver to continuously apply his stepping force of a certain amount to the acceleration pedal 37 and to gradually decrease the stepping force.

In the operation of the acceleration device 1, the stopper arm 36 of the pedal-side rotating member 38 may be rapidly and/or strongly brought into contact with the inner wall surface 150 of the back-side wall portion 15, when the pedal arm 33 is pulled up or when the stepping force to the acceleration pedal 37 by the vehicle driver is rapidly released. When the stopper arm 36 is strongly pushed to the inner wall surface 150, an acting force F1 (as shown in FIG. 4A), which is larger than a predetermined value, is applied to the stopper arm 36.

In the acceleration device 1 of the present embodiment, the pedal-side spring holding portion 35 is so configured to be broken away from the pedal-side boss portion 32 at the mechanically-weaker portion 300, when the acting force F1 larger than the predetermined value is applied to the stopper arm 36. A broken piece 350, which includes the pedal-side spring holding portion 35 broken away from the pedal-side boss portion 32, is pushed to the inner wall surface 150 of the back-side wall portion 15 by the biasing force of the pedal spring 39, as shown in FIG. 4B. Accordingly, the broken piece 350 is held at a predetermined position inside of the supporting body 10, if a part of the pedal-side rotating member 38 (that is, the pedal-side spring holding portion 35 or the like) is broken away at the mechanically-weaker portion 300. It is, therefore, possible to prevent the broken piece 350 from moving in the inner space 11 of the supporting body 10.

As a result, it is possible to prevent the broken piece 350 (including the pedal-side spring holding portion 35) from being brought into contact with the pedal shaft 20 and to prevent the rotational movement thereof from being adversely affected. Therefore, the pedal shaft 20 can be surely rotated depending on the stepping force of the vehicle driver, even after the part of the pedal-side rotating member 38 is broken away. In addition, the acceleration pedal 37 can be surely moved to its acceleration full-close position (the initial position).

Furthermore, in the acceleration device 1 of the present embodiment, the first projection 151 formed at the inner wall surface 150 of the back-side wall portion 15 will be inserted into the second recessed portion 381 formed in the back-side surface of the pedal-side rotating member 38, when the broken piece 350 (including the pedal-side spring holding portion 35) is pushed toward the inner wall surface 150. Accordingly, the broken piece 350 is attached to and held at a position of the first projection 151 not only by the biasing force of the pedal spring 39 but also by the engagement between the first projection 151 and the second recessed portion 381. As above, it is possible to surely prevent the broken piece 350 from adversely affecting the rotation of the pedal shaft 20. Therefore, the pedal shaft 20 can be surely rotated depending on the stepping force of the vehicle driver.

In the present embodiment, the first projection 151 is formed in the inner wall surface 150 of the back-side wall portion 15, while the second recessed portion 381 is formed in the back-side surface of the pedal-side rotating member 38.

Figure 4C:
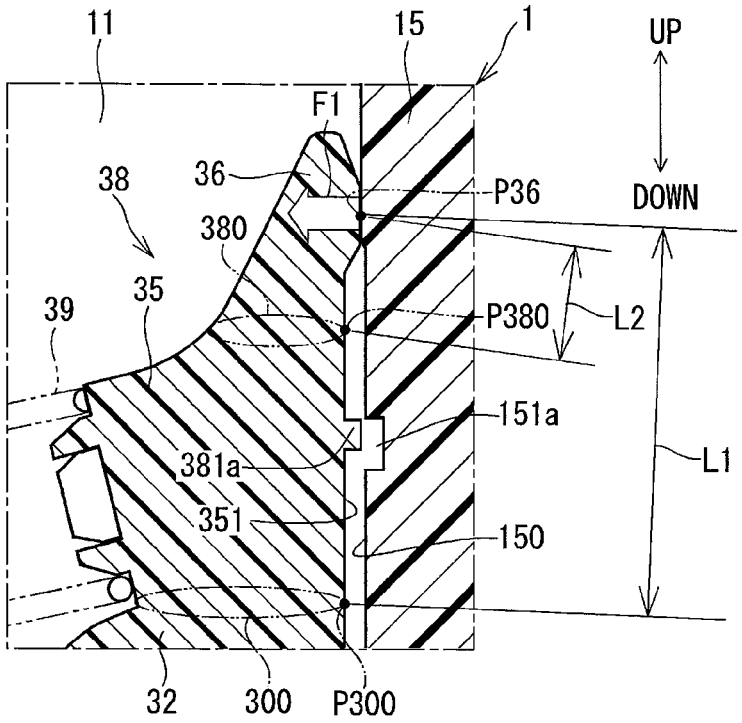

However, the first embodiment may be modified in such a manner as shown in FIG. 4C, wherein a second projection 381*a* is formed in the back-side surface of the pedal-side rotating member 38, while a first recessed portion 151*a* is formed in the inner wall surface 150 of the back-side wall portion 15, so that the second projection 381*a* will be engaged with the first recessed portion 151*a* in a case that the pedal-side spring holding portion 35 is broken away from the pedal-side boss portion 32.

In the present specification, the first projection 151 and the first recessed portion 151*a* (each of which is formed in the inner wall surface 150) are collectively referred to as a first engaging portion, while the second recessed portion 381 and the second projection 381*a* (each of which is formed in the back-side surface of the pedal-side spring holding portion 35) are collectively referred to as a second engaging portion.

Second Embodiment

Figure 5A:
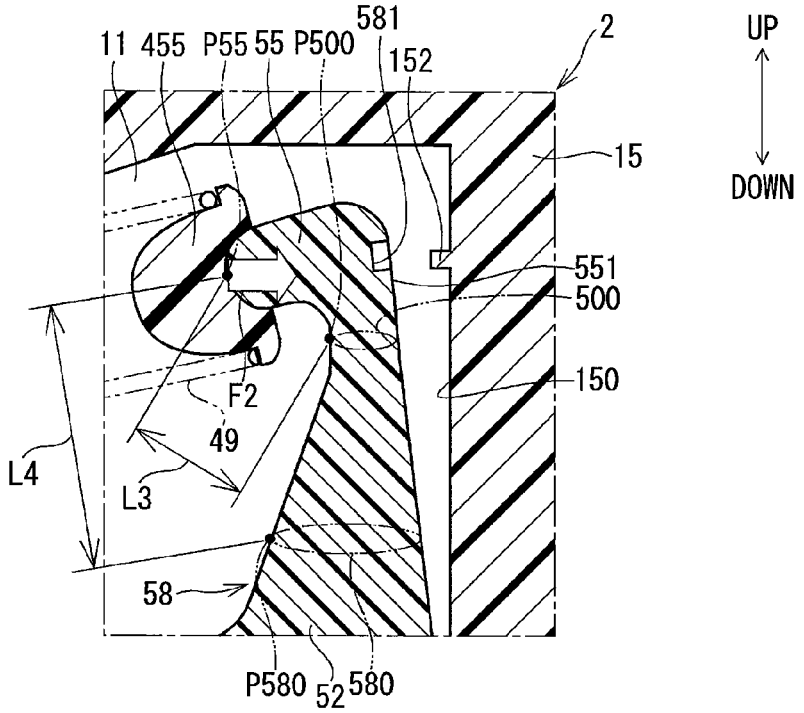
Figure 5B:
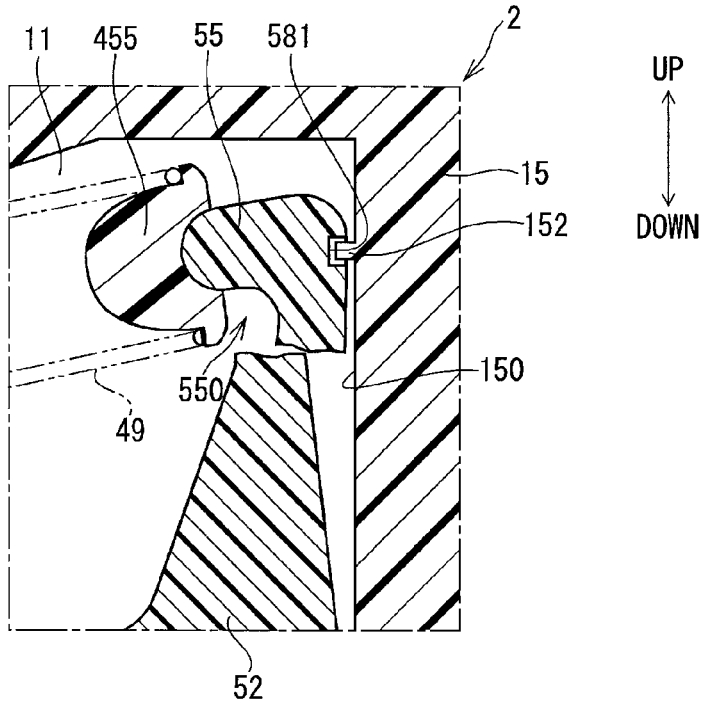

An acceleration device 2 according to a second embodiment of the present disclosure will be explained with reference to FIGS. 5A and 5B. A structure of a hysteresis-side rotating member 58 of the second embodiment differs from that of the first embodiment. Each of FIGS. 5A and 5B is a schematically enlarged cross sectional view showing a relevant portion of the second embodiment, which corresponds to the portion IV of FIG. 2.

In the acceleration device 2 of the present embodiment, the hysteresis-side rotating member 58 is composed of a hysteresis-side boss portion 52 and a hysteresis-side spring holding portion 55 (also referred to as a hysteresis-biasing-member holding portion 55), wherein the hysteresis-side boss portion 52 and the hysteresis-side spring holding portion 55 are integrally formed as one unit.

The hysteresis-side boss portion 52 is arranged between the pedal-side boss portion 32 and the inner wall of the second cover member 18 and at the radial-outside position of the pedal shaft 20. The hysteresis-side boss portion 52 is formed in an annular shape and rotatable relative to the pedal shaft 20 and the pedal-side boss portion 32. In addition, the hysteresis-side boss portion 52 is movable in the axial direction of the pedal shaft 20 with respect to the pedal-side boss portion 32, so that the hysteresis-side boss portion 52 is moved closer to or more separated from the pedal-side boss portion 32.

The hysteresis-side spring holding portion 55 is arranged in the inner space 11 and extends from the hysteresis-side boss portion 52 in the radial-upward direction. The hysteresis-side spring holding portion 55 holds one end of the hysteresis spring 49 via the spring supporting member 455.

The hysteresis-side spring holding portion 55 is connected to the hysteresis-side boss portion 52 via a mechanically-weaker portion 500. The mechanically-weaker portion 500 is formed between the hysteresis-side boss portion 52 and the hysteresis-side spring holding portion 55 as a portion, which is mechanically weaker than other portions of the hysteresis-side rotating member 58.

More exactly, the mechanically-weaker portion 500, which is indicated by a two-dot-chain line in FIG. 5A, is so made as to satisfy the following expression 2:

$$Z3 < Z4 \times (L3/L4) \quad \text{(expression 2)}$$

In the above expression 2;

Z3 is a modulus of section of the mechanically-weaker portion 500;

Z4 is a modulus of section of any arbitrary portion 580, which is any portion of the hysteresis-side rotating member 58 between the hysteresis-side boss portion 52 and the hysteresis-side spring holding portion 55, for example, a portion indicated by another two-dot-chain line in FIG. 5A;

L3 is a distance between an acting point P55 and a mechanically weak point P500, wherein the acting point P55 corresponds to a point of the hysteresis-side spring holding portion 55 to which the biasing force of the hysteresis spring 49 is applied, and the mechanically weak point P500 corresponds to a point of the mechanically-weaker portion 500 on a side closer to the hysteresis spring 49 (that is, a front-side surface of the hysteresis-side rotating member 58, which is equal to a left-hand side of FIG. 5A); and L4 is a distance between the acting point P55 and an arbitrary point P580, wherein the arbitrary point P580 corresponds to a point of the arbitrary portion 580 on the side closer to the hysteresis spring 49 (that is, on the left-hand side of FIG. 5A).

A recessed portion 581 is formed in the hysteresis-side spring holding portion 55 at its back-side surface 551 facing to the inner wall surface 150 of the back-side wall portion 15. A projection 152, which is operatively engaged with the recessed portion 581, is formed in the back-side wall portion 15 at the inner wall surface 150 thereof facing to the recessed portion 581. The recessed portion 581 is also referred to as a fourth recessed portion and the projection 152 is also referred to as a third projection.

In the acceleration device 2, the hysteresis-side rotating member 58 is repeatedly rotated in the pedal opening direction and in the pedal closing direction in accordance with the rotation of the pedal-side rotating member 38. The hysteresis-side rotating member 58 may be mechanically damaged (for example, may be broken) as a result of the repeated rotation thereof in the pedal closing direction, due to possible fatigue or deterioration of material for the related parts.

In the acceleration device 2 of the present embodiment, a forward end of the hysteresis-side rotating member 58 (that is, the hysteresis-side spring holding portion 55) is so configured as to be broken away from the remaining portion of the hysteresis-side rotating member 58 (that is, the hysteresis-side boss portion 52) at the mechanically-weaker portion 500, when an acting force F2 larger than a predetermined value is applied to the hysteresis-side spring holding portion 55.

A broken piece 550, which includes the hysteresis-side spring holding portion 55 broken away from the hysteresis-side boss portion 52, is pushed to the inner wall surface 150 by the biasing force of the hysteresis spring 49, as shown in FIG. 5B. The fourth recessed portion 581 of the broken piece 550 (including the hysteresis-side spring holding portion 55) is engaged with the third projection 152 formed in the inner wall surface 150 of the back-side wall portion 15. Accordingly, the same advantages to those of the first embodiment can be obtained in the acceleration device 2 of the second embodiment.

Figure 5C:
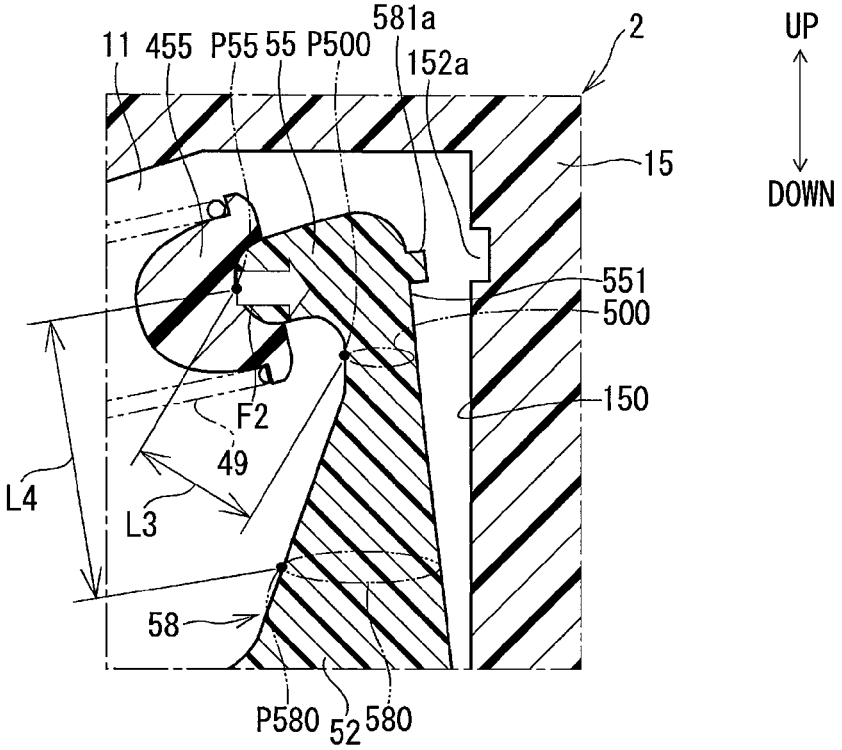

The second embodiment may be also modified in such a way as shown in FIG. 5C, wherein a third recessed portion 152*a* is formed in the inner wall surface 150 of the back-side wall portion 15, while a fourth projection 581*a* is formed in the back-side surface 551 of the hysteresis-side rotating member 58, so that the fourth projection 581*a* is operatively engaged with the third recessed portion 152*a*.

In the present specification, the third projection 152 and the third recessed portion 152*a* (each of which is formed in the inner wall surface 150) are collectively referred to as a third engaging portion, while the fourth recessed portion 581 and the fourth projection 581*a* (each of which is formed in the back-side surface 551 of the hysteresis-side spring holding portion 55) are collectively referred to as a fourth engaging portion.

Third Embodiment

Figure 6A:
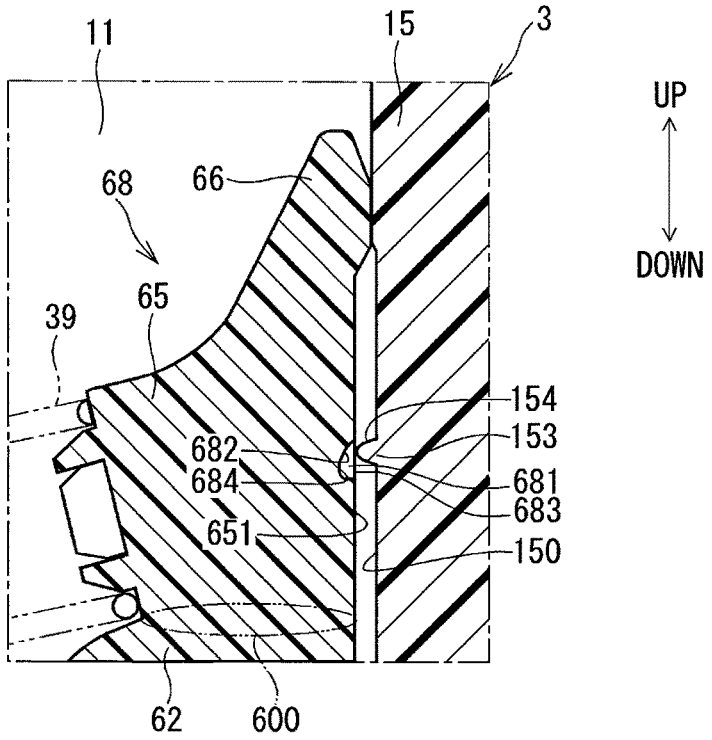
Figure 6B:
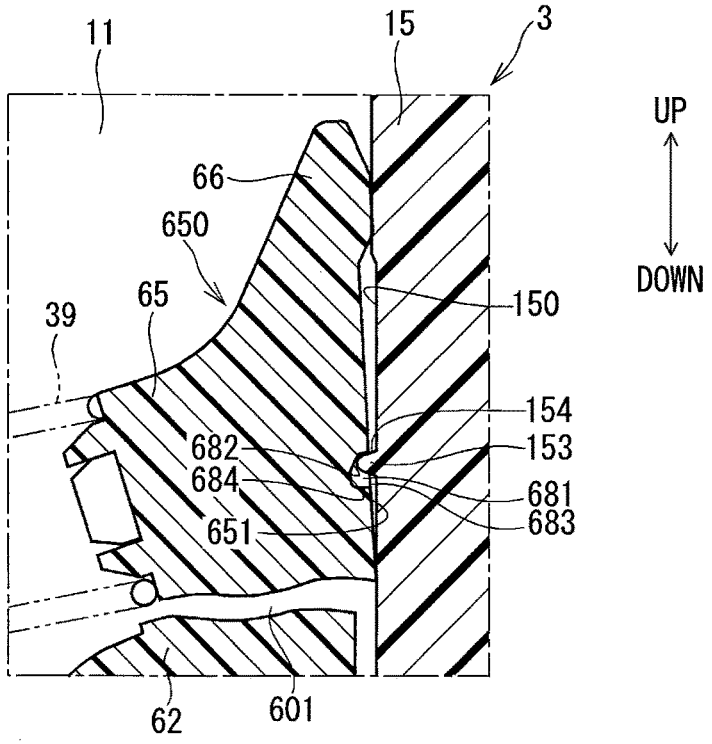

An acceleration device 3 according to a third embodiment of the present disclosure will be explained with reference to FIGS. 6A and 6B. A shape of a recessed portion and a shape of a projection of the third embodiment are different from those of the first embodiment. Each of FIGS. 6A and 6B is likewise a schematically enlarged cross sectional view showing a relevant portion of the third embodiment, which corresponds to the portion IV of FIG. 2.

In the acceleration device 3 of the present embodiment, a pedal-side rotating member 68 is composed of a pedal-side boss portion 62, a pedal-side spring holding portion 65 (also referred to as a pedal-biasing-member holding portion 65), a full-close side stopper portion 66 (also referred to as the stopper arm 66), a mechanically-weaker portion 600 and so on, wherein the pedal-side boss portion 62, the pedal-side spring holding portion 65, the stopper arm 66 and the mechanically-weaker portion 600 are integrally formed as one unit.

The pedal-side boss portion 62 is arranged between the shaft supporting portion 13 and the second cover member 18. The pedal-side boss portion 62 is fixed to the outer peripheral surface of the pedal shaft 20.

The pedal-side spring holding portion 65 is arranged in the inner space 11 and extends from the pedal-side boss portion 62 in the radial-upward direction. The pedal-side spring holding portion 65 holds one end of the pedal spring 39.

The stopper arm 66 further extends in the inner space 11 from the pedal-side spring holding portion 65 in the radial-upward direction. When the stopper arm 66 is brought into contact with the inner wall surface 150 of the back-side wall portion 15, the rotation of the pedal-side rotating member 68 in the pedal closing direction is limited and the pedal-side rotating member 68 is maintained at its acceleration fully-closed position.

The pedal-side spring holding portion 65 is connected to the pedal-side boss portion 62 by the mechanically-weaker portion 600, which is indicated by a two-dot-chain line in FIG. 6A.

A recessed portion 681 is formed in the pedal-side spring holding portion 65 at its back-side surface 651 facing to the inner wall surface 150 of the back-side wall portion 15, with which the stopper arm 66 is operatively brought into contact. As shown in FIG. 6A, an inside contacting surface 682 of an upper side of the recessed portion 681 is inclined in a direction from an open side 683 to a bottom side 684 of the recessed portion 681, so that a depth of the recessed portion 681 is gradually increased in a direction from the pedal-side spring holding portion 65 to the pedal-side boss portion 62 (in a radial-inward direction). The recessed portion 681 is also referred to as the second recessed portion.

A projection 153, which is operatively engaged with the recessed portion 681, is formed in the inner wall surface 150 of the back-side wall portion 15. The projection 153 is formed at such a position, which is more separated from the pedal-side boss portion 62 in the radial-upward direction (a radial-outward direction) when compared with a position of the recessed portion 681. More exactly, a center point of the projection 153 in the radial-outward direction (or a top point of the projection 153) is located at a position, which is more separated from a center point of the recessed portion 681 (or a deepest bottom point of the recessed portion 681) in the radial-outward direction, when compared the positions of both center points with each other in the radial-outward direction.

As shown in FIG. 6A, an outside contacting surface 154 of an upper side of the projection 153 is inclined in a direction from the top point to a root point of the projection 153, so that a height of the projection 153 is gradually increased in a direction from the root point to the top point of the projection 153 (in the radial-inward direction). The projection 153 is also referred to as the first projection.

In the acceleration device 3 of the present embodiment, the pedal-side spring holding portion 65 is so configured as to be broken away from the pedal-side boss portion 62 at the mechanically-weaker portion 600, when the stopper arm 66 of the pedal-side rotating member 68 is strongly brought into contact with the inner wall surface 150 of the back-side wall portion 15.

When a broken piece 650 including the pedal-side spring holding portion 65 is pushed by the biasing force of the pedal spring 39 to the inner wall surface 150 of the back-side wall portion 15, the inside contacting surface 682 of the recessed portion 681 is brought into contact with the outside contacting surface 154 of the projection 153. Then, the broken piece 650 including the pedal-side spring holding portion 65 is moved in the radial-outward direction along the outside contacting surface 154 of the projection 153, because the projection 153 is formed at the position more separated from the pedal-side boss portion 62 in the radial-outward direction when compared with the position of the recessed portion 681.

As a result, a relatively large gap 601 is formed between the broken piece 650 including the pedal-side spring holding portion 65 and the pedal-side boss portion 62, as shown in FIG. 6B.

In the acceleration device 3 of the present embodiment, the pedal-side boss portion 62 is rotated together with the rotation of the pedal shaft 20, even after the pedal-side spring holding portion 65 is broken away from the pedal-side boss portion 62. Since the broken piece 650 is held at such a position of the inner wall surface 150 with the gap 601, the pedal-side boss portion 62 can be continuously rotated without being adversely affected. As above, it is possible to surely rotate the pedal-side boss portion 62 in the third embodiment, in addition to the advantages obtained in the first embodiment.

Figure 6C:
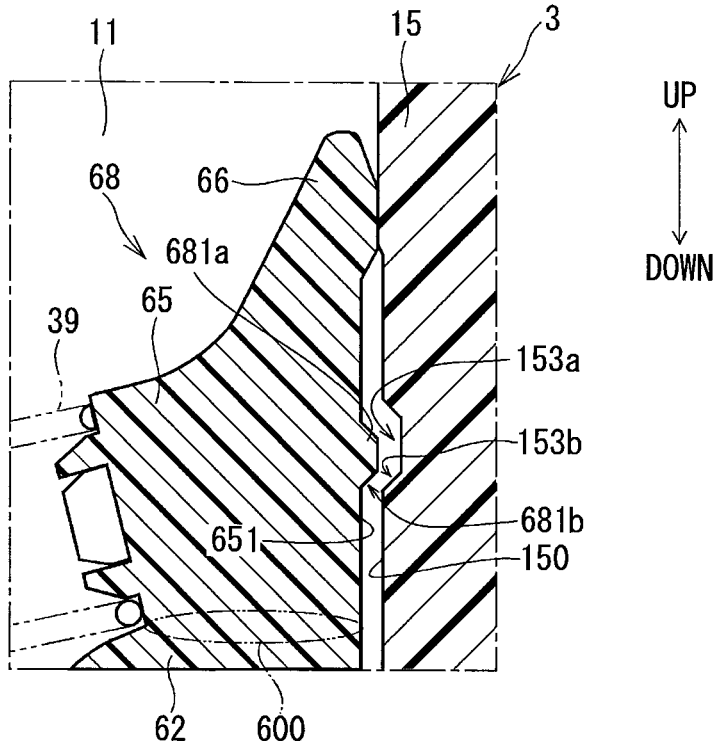

The third embodiment may be also modified in such a way as shown in FIG. 6C, wherein a first recessed portion 153*a* is formed in the inner wall surface 150 of the back-side wall portion 15, while a second projection 681*a* is formed in the back-side surface 651 of the pedal-side rotating member 68, so that the second projection 681*a* will be engaged with the first recessed portion 153*a* when the pedal-side spring holding portion 65 is broken away from the pedal-side boss portion 62. As is further shown in FIG. 6C, an inside contacting surface 153*b* of a lower side of the first recessed portion 153*a* is inclined in a direction from an open side to a bottom side of the first recessed portion 153*a*, so that a depth of the first recessed portion 153*a* is gradually increased in the radial-outward direction. In addition, an outside contacting surface 681*b* of a lower side of the second projection 681*a* is inclined in a direction from a root point to a top point of the second projection 681*a*, so that a height of the second projection 681*a* is gradually increased in the radial-outward direction.

In the present specification, the first projection 153 and the first recessed portion 153*a* (each of which is formed in the inner wall surface 150) are also collectively referred to as the first engaging portion, while the second recessed portion 681 and the second projection 681*a* (each of which is formed in the back-side surface of the pedal-side spring holding portion 65) are also collectively referred to as the second engaging portion.

Fourth Embodiment

Figure 7A:
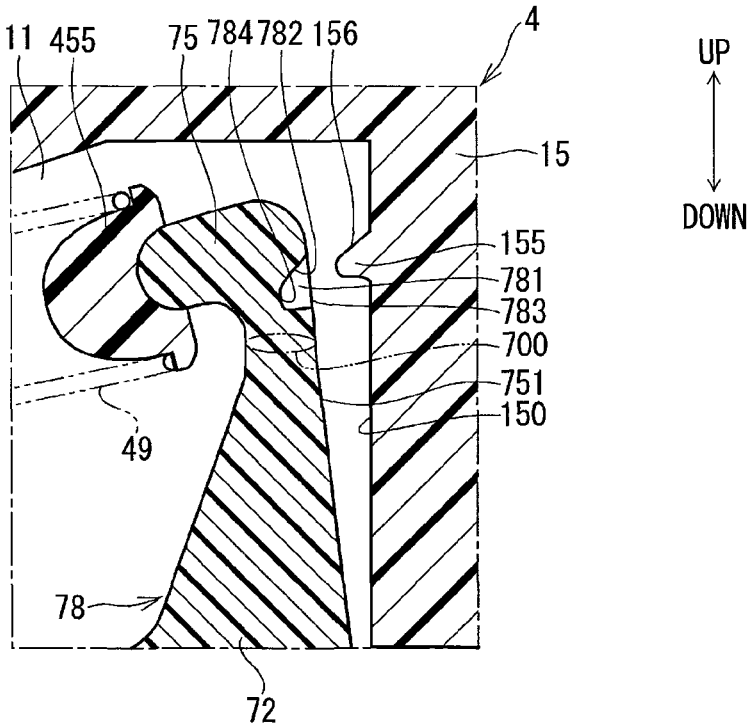
Figure 7B:
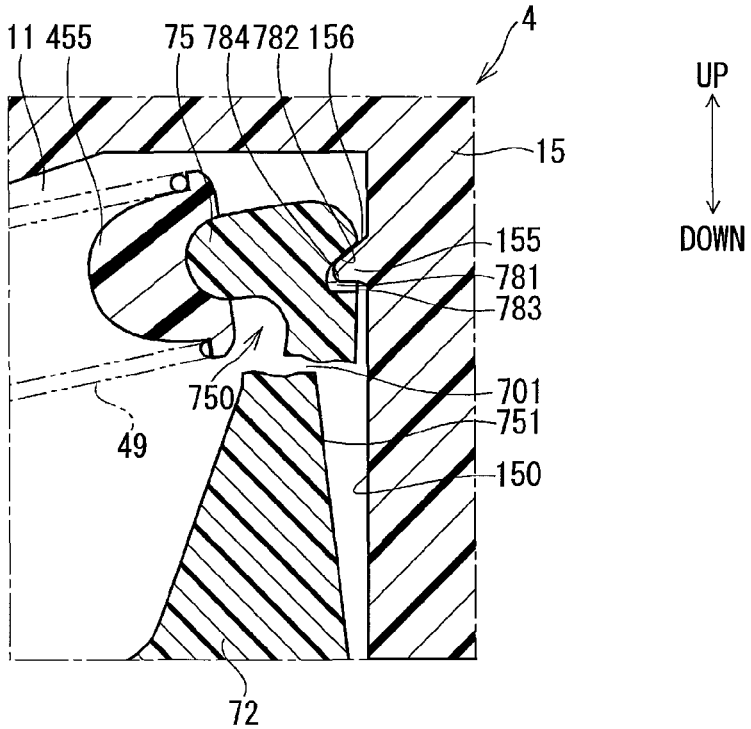

An acceleration device 4 according to a fourth embodiment of the present disclosure will be explained with reference to FIGS. 7A and 7B. A shape of a recessed portion formed in a hysteresis-side rotating member and a shape of a projection formed in a supporting body of the fourth embodiment are different from those of the second embodiment. Each of FIGS. 7A and 7B is likewise a schematically enlarged cross sectional view showing a relevant portion of a hysteresis-side rotating member 78 of the fourth embodiment, which corresponds to the portion IV of FIG. 2.

In the acceleration device 4, the hysteresis-side rotating member 78 is composed of a hysteresis-side boss portion 72, hysteresis-side spring holding portion 75 (also referred to as the hysteresis-biasing-member holding portion), a mechanically-weaker portion 700, wherein the hysteresis-side boss portion 72, the hysteresis-side spring holding portion 75 and the mechanically-weaker portion 700 are integrally formed as one unit.

The hysteresis-side boss portion 72 is arranged between the pedal-side boss portion 32 and the inner wall of the second cover member 18 and at the radial-outside position of the pedal shaft 20. The hysteresis-side boss portion 72 is formed in an annular shape and rotatable relative to the pedal shaft 20 and the pedal-side boss portion 32. In addition, the hysteresis-side boss portion 72 is movable in the axial direction of the pedal shaft 20 with respect to the pedal-side boss portion 32, so that the hysteresis-side boss portion 72 is moved closer to or more separated from the pedal-side boss portion 32.

The hysteresis-side spring holding portion 75 is arranged in the inner space 11 and extends from the hysteresis-side boss portion 72 in the radial-upward direction. The hysteresis-side spring holding portion 75 holds one end of the hysteresis spring 49 via the spring supporting member 455.

The mechanically-weaker portion 700 corresponds to a portion of the hysteresis-side rotating member 78, which is indicated by a two-dot-chain line in FIG. 7A. The mechanically-weaker portion 700 connects the hysteresis-side spring holding portion 75 to the hysteresis-side boss portion 72.

A recessed portion 781 is formed in the hysteresis-side spring holding portion 75 at its back-side surface 751 facing to the inner wall surface 150 of the back-side wall portion 15. As shown in FIG. 7A, an inside contacting surface 782 of an upper side of the recessed portion 781 is inclined in a direction from an open side 783 to a bottom side 784 of the recessed portion 781, so that a depth of the recessed portion 781 is gradually increased in a direction from the hysteresis-side spring holding portion 75 to the hysteresis-side boss portion 72 (in the radial-inward direction). The recessed portion 781 is also referred to as the fourth recessed portion.

A projection 155, which is operatively engaged with the recessed portion 781, is formed in the inner wall surface 150 of the back-side wall portion 15. The projection 155 is formed at such a position, which is more separated from the hysteresis-side boss portion 72 in the radial-upward direction (the radial-outward direction) when compared with a position of the recessed portion 781. More exactly, a center point of the projection 155 in the radial-outward direction (or a top point of the projection 155) is located at a position, which is more separated from a center point of the recessed portion 781 (or a deepest bottom point of the recessed portion 781) in the radial-outward direction, when compared the positions of both center points with each other in the radial-outward direction.

As shown in FIG. 7A, an outside contacting surface 156 of an upper side of the projection 155 is inclined in a direction from the top point to a root point of the projection 155, so that a height of the projection 155 is gradually increased in a direction from the root point to the top point of the projection 155 (in the radial-inward direction). In other words, the height of the projection 155 is decreased in the radial-outward direction from the top point to the root point of the projection 155 (that is, a direction away from the hysteresis-side boss portion 72). The projection 155 is also referred to as the third projection.

In the acceleration device 4 of the present embodiment, the hysteresis-side spring holding portion 75 is so configured as to be broken away from the hysteresis-side boss portion 72 at the mechanically-weaker portion 700, when the hysteresis-side rotating member 78 will be broken due to an excess outside force applied thereto.

When a broken piece 750 including the hysteresis-side spring holding portion 75 is pushed by the biasing force of the hysteresis spring 49 to the inner wall surface 150 of the back-side wall portion 15, the inside contacting surface 782 of the recessed portion 781 is brought into contact with the outside contacting surface 156 of the projection 155. Then, the broken piece 750 including the hysteresis-side spring holding portion 75 is moved in the radial-outward direction along the outside contacting surface 156 of the projection 155, because the projection 155 is formed at the position more separated from the hysteresis-side boss portion 72 in the radial-outward direction when compared with the position of the recessed portion 781.

As a result, a relatively large gap 701 is formed between the broken piece 750 including the hysteresis-side spring holding portion 75 and the hysteresis-side boss portion 72, as shown in FIG. 7B.

In the acceleration device 4 of the present embodiment, the hysteresis-side boss portion 72 is rotatable without being adversely affected by the broken piece 750 (which is held at such a position of the inner wall surface 150 with the gap 701), even after the hysteresis-side spring holding portion 75 is broken away from the hysteresis-side boss portion 72. As above, it is possible to surely rotate the hysteresis-side boss portion 72 in the fourth embodiment, in addition to the advantages obtained in the second embodiment.

Figure 7C:
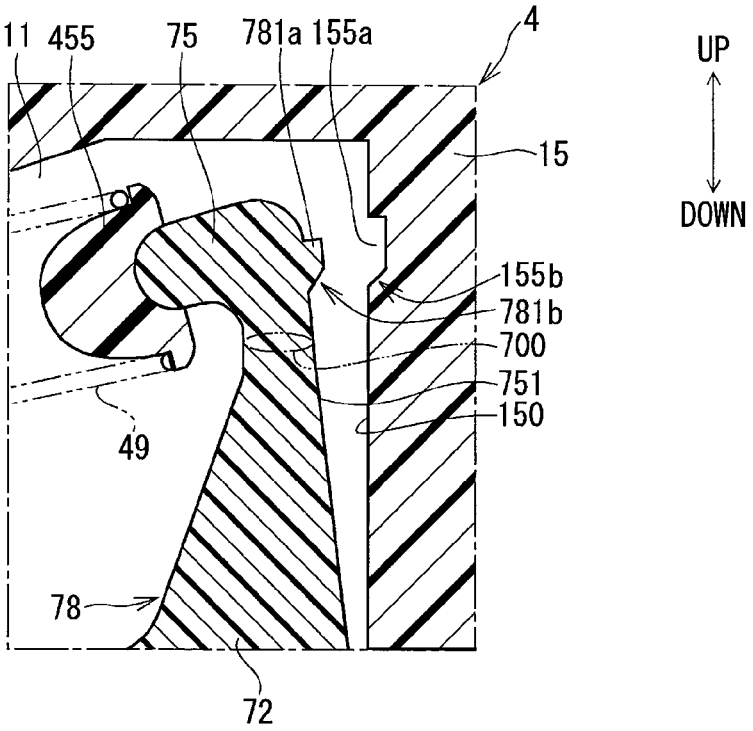

The fourth embodiment may be also modified in such a way as shown in FIG. 7C, wherein a third recessed portion 155*a* is formed in the inner wall surface 150 of the back-side wall portion 15, while a fourth projection 781*a* is formed in the back-side surface 751 of the hysteresis-side rotating member 78, so that the fourth projection 781*a* is operatively engaged with the third recessed portion 155*a*. As is further shown in FIG. 7C, an outside contacting surface 155*b* of a lower side of the third recessed portion 155*a* is inclined in a direction from an open side to a bottom side of the third recessed portion 155*a*, so that a depth of the third recessed portion 155*a* is gradually increased in the radial-outward direction. In addition, an inside contacting surface 781*b* of a lower side of the fourth projection 781*a* is inclined in a direction from a root point to a top point of the fourth projection 781*a*, so that a height of the fourth projection 781*a* is gradually increased in the radial-outward direction.

In the present specification, the third projection 155 and the third recessed portion 155*a* (each of which is formed in the inner wall surface 150) are also collectively referred to as the third engaging portion, while the fourth recessed portion 781 and the fourth projection 781*a* (each of which is formed in the back-side surface 751 of the hysteresis-side spring holding portion 75) are also collectively referred to as the fourth engaging portion.

Fifth Embodiment

Figure 8A:
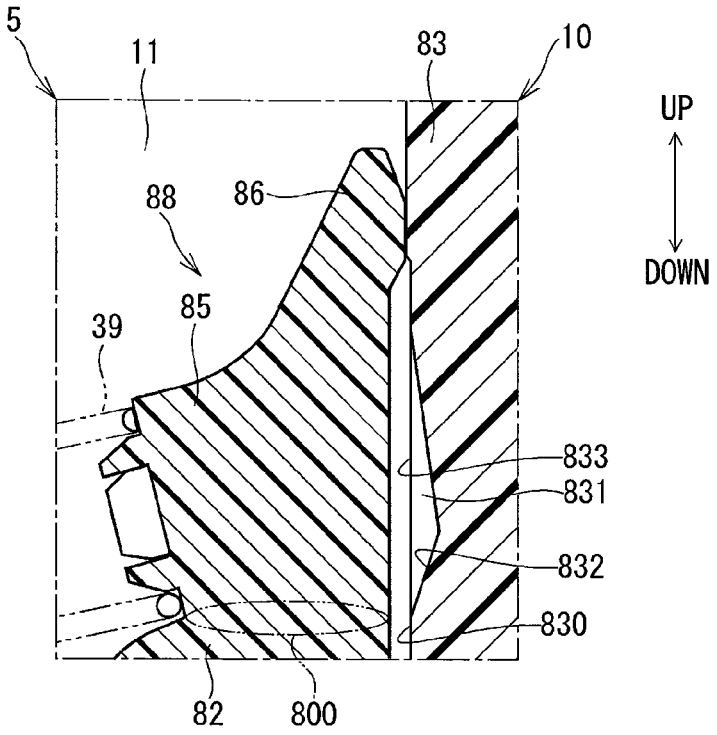
FIGS. 8A and 8B are schematically enlarged cross sectional views, each showing a relevant portion of an acceleration device according to a fifth embodiment of the present disclosure.
Figure 8B:
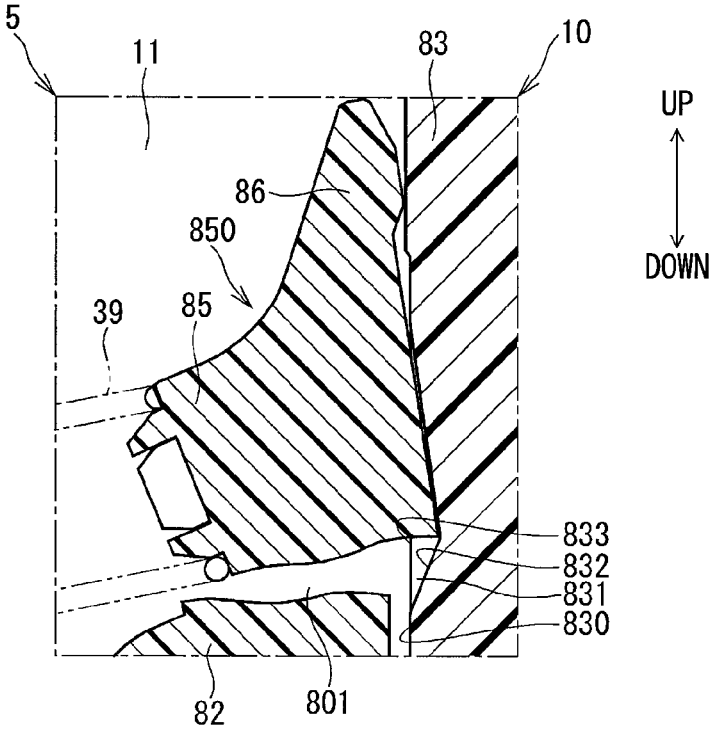

An acceleration device 5 according to a fifth embodiment of the present disclosure will be explained with reference to FIGS. 8A and 8B. The fifth embodiment is different from the first embodiment in that the supporting body 10 of the fifth embodiment has a relatively large recessed portion in the inner wall surface of the back-side wall portion for accommodating a part of a broken piece. Each of FIGS. 8A and 8B is likewise a schematically enlarged cross sectional view showing a relevant portion of a pedal-side rotating member 88 of the fifth embodiment, which corresponds to the portion IV of FIG. 2.

In the acceleration device 5 of the present embodiment, the pedal-side rotating member 88 is composed of a pedal-side boss portion 82, a pedal-side spring holding portion 85 (also referred to as a pedal-biasing-member holding portion 85), a full-close side stopper portion 86 (also referred to as the stopper arm 86), a mechanically-weaker portion 800 and so on, wherein the pedal-side boss portion 82, the pedal-side spring holding portion 85, the stopper arm 86 and the mechanically-weaker portion 800 are integrally formed as one unit.

The pedal-side boss portion 82 is arranged between the shaft supporting portion 13 and the second cover member 18. The pedal-side boss portion 82 is fixed to the outer peripheral surface of the pedal shaft 20.

The pedal-side spring holding portion 85 is arranged in the inner space 11 and extends from the pedal-side boss portion 82 in the radial-upward direction. The pedal-side spring holding portion 85 holds one end of the pedal spring 39.

The stopper arm 86 further extends in the inner space 11 from the pedal-side spring holding portion 85 in the radial-upward direction. When the stopper arm 86 is brought into contact with the inner wall surface 150 of the back-side wall portion 15, the rotation of the pedal-side rotating member 88 in the pedal closing direction is limited and the pedal-side rotating member 88 is maintained at the acceleration fully-closed position.

The pedal-side spring holding portion 85 is connected to the pedal-side boss portion 82 by the mechanically-weaker portion 800, which is indicated by a two-dot-chain line in FIG. 8A.

In the acceleration device 5 of the present embodiment, a relatively large recessed portion 831 is formed in an inner wall surface 830 of a back-side wall portion 83 of the supporting body 10, instead of a recessed portion formed in the pedal-side rotating member to be engaged with a projection formed in the back-side wall portion. The recessed portion 831 is also referred to as a first accommodating space. As shown in FIG. 8A, an inside contacting surface 832 of a lower side of the recessed portion 831 is inclined in such a manner that a depth thereof between an open side 833 to a bottom side is gradually increased in the radial-outward direction (that is, a direction away from the pedal-side boss portion 82 to the stopper arm 86).

In the acceleration device 5 of the present embodiment, the pedal-side spring holding portion 85 is so configured as to be broken away from the pedal-side boss portion 82 at the mechanically-weaker portion 800, when the stopper arm 86 of the pedal-side rotating member 88 is strongly brought into contact with the inner wall surface 830 of the back-side wall portion 83 and thereby the pedal-side rotating member 88 is broken due to the excess outside force applied thereto.

When a broken piece 850 including the pedal-side spring holding portion 85 is pushed by the biasing force of the pedal spring 39 to the inner wall surface 830 of the back-side wall portion 83, the broken piece 850 is brought into contact with the inside contacting surface 832 of the recessed portion 831. Then, the broken piece 850 including the pedal-side spring holding portion 85 is moved in the radial-outward direction along the inside contacting surface 832 of the recessed portion 831, because the inside contacting surface 832 is inclined in the radial-outward direction.

As a result, a part of the broken piece 850 is accommodated in the recessed portion 831 (the first accommodating space 831) and a relatively large gap 801 is formed between the broken piece 850 including the pedal-side spring holding portion 85 and the pedal-side boss portion 82, as shown in FIG. 8B.

In the acceleration device 5 of the present embodiment, since the broken piece 850 is held at such a position of the inner wall surface 830 with the gap 801, the pedal-side boss portion 82 can be surely rotated without being adversely affected by the broken piece 850.

Sixth Embodiment

Figure 9A:
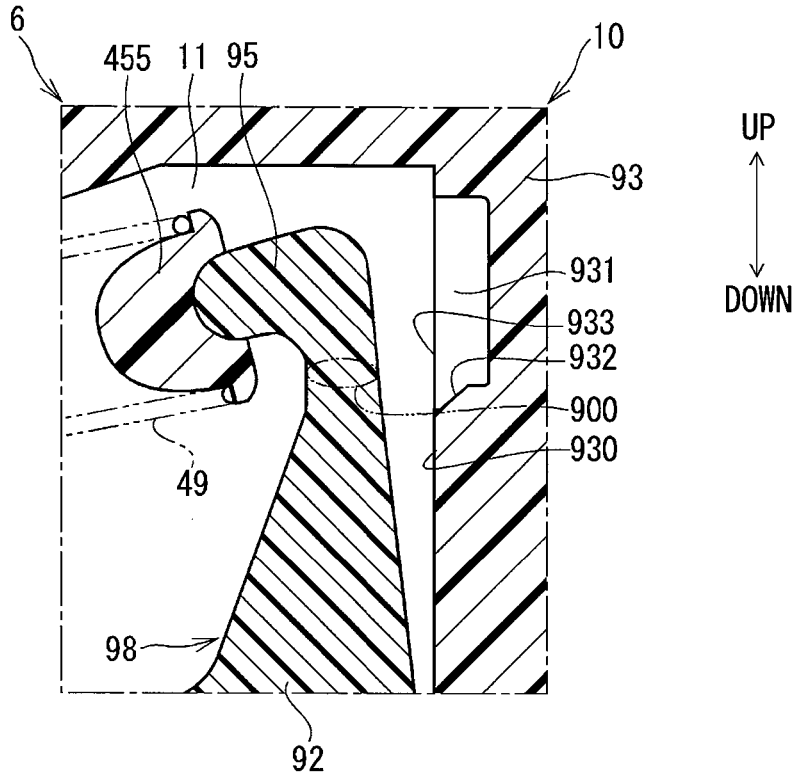
FIGS. 9A and 9B are schematically enlarged cross sectional views, each showing a relevant portion of an acceleration device according to a sixth embodiment of the present disclosure.
Figure 9B:
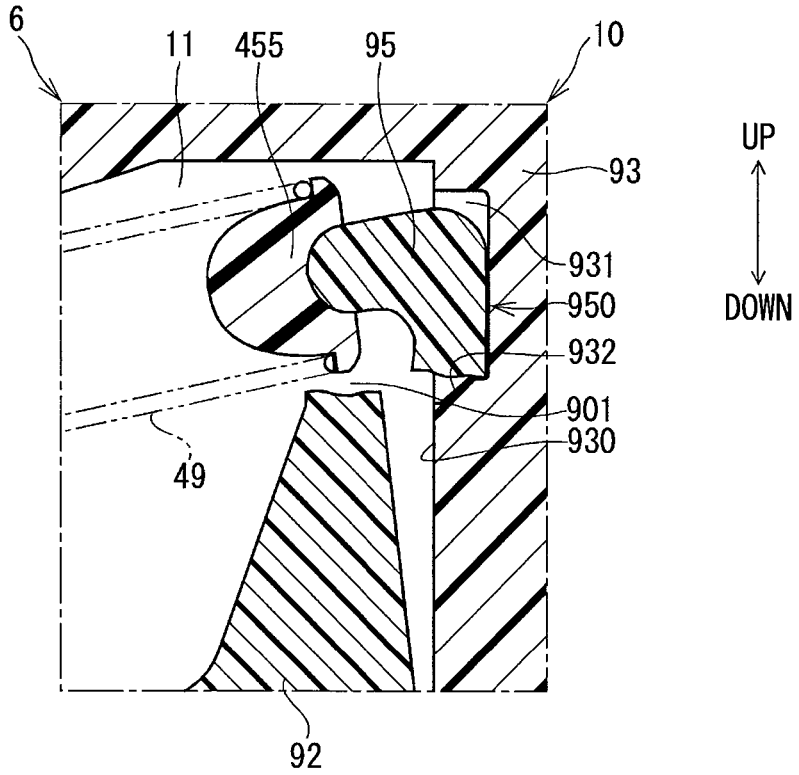

An acceleration device 6 according to a sixth embodiment of the present disclosure will be explained with reference to FIGS. 9A and 9B. The sixth embodiment is different from the second embodiment in that the supporting body 10 of the sixth embodiment has a relatively large recessed portion in the inner wall surface of the back-side wall portion for accommodating a part of a broken piece. Each of FIGS. 9A and 9B is likewise a schematically enlarged cross sectional view showing a relevant portion of a hysteresis-side rotating member 98 of the sixth embodiment, which corresponds to the portion IV of FIG. 2.

In the acceleration device 6, the hysteresis-side rotating member 98 is composed of a hysteresis-side boss portion 92, a hysteresis-side spring holding portion 95 (also referred to as the hysteresis-biasing-member holding portion), a mechanically-weaker portion 900, wherein the hysteresis-side boss portion 92, the hysteresis-side spring holding portion 95 and the mechanically-weaker portion 900 are integrally formed as one unit.

The hysteresis-side boss portion 92 is arranged between the pedal-side boss portion 32 and the inner wall of the second cover member 18 and at the radial-outside position of the pedal shaft 20. The hysteresis-side boss portion 92 is formed in an annular shape and rotatable relative to the pedal shaft 20 and the pedal-side boss portion 32. In addition, the hysteresis-side boss portion 92 is movable in the axial direction of the pedal shaft 20 with respect to the pedal-side boss portion 32, so that the hysteresis-side boss portion 92 is moved closer to or more separated from the pedal-side boss portion 32.

The hysteresis-side spring holding portion 95 is arranged in the inner space 11 and extends from the hysteresis-side boss portion 92 in the radial-outward direction. The hysteresis-side spring holding portion 95 holds one end of the hysteresis spring 49 via the spring supporting member 455.

The mechanically-weaker portion 900 corresponds to a portion of the hysteresis-side rotating member 98, which is indicated by a two-dot-chain line in FIG. 9A. The mechanically-weaker portion 900 connects the hysteresis-side spring holding portion 95 to the hysteresis-side boss portion 92.

In the acceleration device 6, a relatively large recessed portion 931 is formed at an inner wall surface 930 of a back-side wall portion 93 of the supporting body 10, instead of a recessed portion formed in the hysteresis-side rotating member to be engaged with a projection formed in the back-side wall portion. As shown in FIG. 9A, an inside contacting surface 932 of a lower side of the recessed portion 931 is inclined in such a manner that a depth thereof between an open side 933 to a bottom side is gradually increased in the radial-outward direction (that is, a direction away from the hysteresis-side boss portion 92 to the hysteresis-side spring holding portion 95).

In the acceleration device 6 of the present embodiment, the hysteresis-side spring holding portion 95 is so configured as to be broken away from the hysteresis-side boss portion 92 at the mechanically-weaker portion 900, when the hysteresis-side rotating member 98 is broken.

When a broken piece 950 including the hysteresis-side spring holding portion 95 is pushed by the biasing force of the hysteresis spring 49 to the inner wall surface 930 of the back-side wall portion 93, the broken piece 950 is brought into contact with the inside contacting surface 932 of the recessed portion 931. Then, the broken piece 950 including the hysteresis-side spring holding portion 95 is moved in the radial-outward direction along the inside contacting surface 932 of the recessed portion 931, because the inside contacting surface 932 is inclined in the radial-outward direction.

As a result, a part of the broken piece 950 is accommodated in the recessed portion 931 (a second accommodating space) and a relatively large gap 901 is formed between the broken piece 950 including the hysteresis-side spring holding portion 95 and the hysteresis-side boss portion 92, as shown in FIG. 9B.

In the acceleration device 6 of the present embodiment, since the broken piece 950 is held at such a position of the inner wall surface 930 with the gap 901, the hysteresis-side boss portion 92 can be surely rotated without being adversely affected by the broken piece 950, in addition to the advantages of the second embodiment.

Further Embodiments and/or Modifications (1) In the above embodiments, the mechanically-weaker portion (300, 500, 600, 700, 800 or 900) is formed in either the pedal-side rotating member (38, 68, 88) or the hysteresis-side rotating member (58, 78, 98). However, the mechanically-weaker portions may be formed in both of the pedal-side rotating member and the hysteresis-side rotating member.

(2) In the above first and the third embodiments, the pedal-side rotating member (38, 68) has the second recessed portion (381, 681), while the supporting body (10) has the first projection (151, 153). On the other hand, in the above second and the fourth embodiments, the hysteresis-side rotating member (58, 78) has the fourth recessed portion (581, 781), while the supporting body (10) has the third projection (152, 155). However, as already explained with reference to FIGS. 4C, 5C, 6C and 7C, a projection may be formed in the pedal-side or the hysteresis-side rotating member and a recessed portion (with which the projection is engaged) may be formed in the supporting body. In this case, the recessed portion may be formed at such a position of the supporting body, which is more separated from a pedal-side or a hysteresis-side boss portion than a position of the projection formed in the pedal-side or the hysteresis-side rotating member.

(3) In the above third embodiment, the inside contacting surface (682) of the upper side in the second recessed portion (681), which is formed in the pedal-side rotating member (68), is inclined from the open side (683) toward the bottom side (684) in the direction from the pedal-side spring holding portion (65) to the pedal-side boss portion (62) (in the radial-inward direction). In addition, the outside contacting surface (154) of the upper side in the first projection (153), which is formed in the supporting body (10), is inclined from the top point toward the root point in the direction away from the pedal-side boss portion (62) (in the radial-outward direction). In the above fourth embodiment, the inside contacting surface (782) of the upper side in the fourth recessed portion (781), which is formed in the hysteresis-side rotating member (78), is inclined from the open side (783) toward the bottom side (784) in the direction from the hysteresis-side spring holding portion (75) to the hysteresis-side boss portion (72) (in the radial-inward direction). In addition, the outside contacting surface (156) of the upper side in the third projection (155), which is formed in the supporting body (10), is inclined from the top point toward the root point in the radial-outward direction away from the hysteresis-side boss portion (72).

However, a relation between the recessed portion and the projection is not limited to the relations of the above embodiments. For example, an inclined surface may be formed either in the recessed portion or in the projection, so that the broken piece (650, 750) including the pedal-side or the hysteresis-side spring holding portion (65, 75) is moved in the radial-outward direction.

(4) In the first and the third embodiments, the pedal-side spring holding portion (35, 65) has the second recessed portion (381, 681) to be engaged with the first projection (151, 153) formed in the back-side wall portion (15). A position at which the second recessed portion is formed is not limited to the position of the above embodiments. The second recessed portion may be formed at any location of the pedal-side spring holding portion (the broken piece), which is so configured as to be broken away from the pedal-side boss portion, on a side of the broken piece opposing to the inner wall surface of the back-side wall portion.

(5) In the above first, the third or the fifth embodiment, the hysteresis mechanism (40) is provided. The present disclosure, however, can be applied to such an acceleration device having no hysteresis mechanism.

The present disclosure should not be limited to the above embodiments and/or modifications, but can be further modified in various manners without departing from a spirit of the present disclosure.

What is claimed is:

1. An acceleration device for an automotive vehicle comprising:

a supporting body to be fixed to a vehicle body;

a pedal shaft rotatably supported by the supporting body;

a pedal-side rotating member provided at a radial-outer side of the pedal shaft and rotatable in accordance with rotation of the pedal shaft;

a pedal-side biasing member for biasing the pedal-side rotating member in a pedal closing direction;

an acceleration pedal to be operated by a vehicle driver;

a pedal arm connected at its one end to the acceleration pedal and converting a stepping movement of the acceleration pedal by the vehicle driver into a rotational torque of the pedal shaft; and a rotational angle detecting unit for detecting a rotational angle of the pedal shaft with respect to the supporting body, wherein the pedal-side rotating member comprises;

a pedal-side boss portion formed at the radial-outer side of the pedal shaft;

a pedal-side biasing-member holding portion extending from the pedal-side boss portion in a radial-outward direction of the pedal shaft for holding one end of the pedal-side biasing member;

a mechanically-weaker portion formed between the pedal-side boss portion and the pedal-side biasing-member holding portion; and a stopper arm extending from the pedal-side biasing-member holding portion in the radial-outward direction opposite to the pedal-side boss portion, wherein the stopper arm is configured to contact with an inner wall surface of the supporting body due to movement of the acceleration pedal to an acceleration fully-closed position, wherein the pedal-side boss portion, the pedal-side biasing-member holding portion and the mechanically-weaker portion are integrally formed as one unit, wherein the pedal-side biasing-member holding portion is configured to be broken away from the pedal-side boss portion at the mechanically-weaker portion as a result of an acting force larger than a predetermined value in the pedal closing direction being applied to the pedal-side rotating member, wherein a first engaging portion is formed at the inner wall surface of the supporting body, wherein a second engaging portion is formed at a back-side surface of the pedal-side rotating member between the stopper arm and the mechanically-weaker portion and facing to the inner wall surface of the supporting body, wherein the second engaging portion is configured to engage with the first engaging portion as a result of the pedal-side biasing-member holding portion being broken away from the pedal-side boss portion, and wherein the first engaging portion comprises one of a projection and a recessed portion, while the second engaging portion comprises the other of the projection and the recessed portion.

2. The acceleration device according to claim 1, wherein the following expression is satisfied:

$$Z1<Z2\times(L1/L2)$$

wherein

Z1 is a modulus of section of the mechanically-weaker portion;

Z2 is a modulus of section of any arbitrary portion, which is any portion of the pedal-side rotating member between the mechanically-weaker portion and the stopper arm;

L1 is a distance between a contacting point and a mechanically weak point, wherein the contacting point corresponds to a point of the stopper arm to be in contact with the inner wall surface of the supporting body and the mechanically weak point corresponds to a point of the mechanically-weaker portion facing to the inner wall surface of the supporting body; and L2 is a distance between the contacting point and an arbitrary point, wherein the arbitrary point corresponds to a point of the arbitrary portion facing to the inner wall surface of the supporting body.

3. The acceleration device according to claim 1, wherein a gap is formed between the pedal-side boss portion and the pedal-side biasing-member holding portion so that the pedal-side boss portion is rotatable, when the pedal-side biasing-member holding portion is broken away from the pedal-side boss portion and the second engaging portion is engaged with the first engaging portion.

4. The acceleration device according to claim 1, wherein the first engaging portion is formed in the supporting body at such a position, which is more separated from the pedal-side boss portion in a radial-outward direction of the pedal-side rotating member than a position of the second engaging portion.

5. The acceleration device according to claim 4, wherein the first engaging portion is composed of a first projection formed at the inner wall surface of the supporting body, the second engaging portion is composed of a second recessed portion formed at the back-side surface of the pedal-side rotating member, a radial-outer side contacting surface of the first projection is inclined from a top point of the first projection to a root point of the first projection, so that a height of the first projection is gradually decreased in the radial-outward direction from the top point to the root point of the first projection.

6. The acceleration device according to claim 4, wherein the first engaging portion is composed of a first projection formed at the inner wall surface of the supporting body, the second engaging portion is composed of a second recessed portion formed at the back-side surface of the pedal-side rotating member, and a radial-outer side contacting surface of the second recessed portion is inclined from an open end of the second recessed portion to a bottom end of the second recessed portion, so that a depth of the second recessed portion is gradually decreased in the radial-outward direction from the bottom end of the second recessed portion.

7. The acceleration device according to claim 4, wherein the first engaging portion is composed of a first recessed portion formed at the inner wall surface of the supporting body, the second engaging portion is composed of a second projection formed at the back-side surface of the pedal-side rotating member, a radial-inner side contacting surface of the second projection is inclined from a top point of the second projection to a root point of the second projection, so that a height of the second projection is gradually decreased in a radial-inward direction from the top point to the root point of the second projection.

8. The acceleration device according to claim 4, wherein the first engaging portion is composed of a first recessed portion formed at the inner wall surface of the supporting body, the second engaging portion is composed of a second projection formed at the back-side surface of the pedal-side rotating member, and a radial-inner side contacting surface of the first recessed portion is inclined from an open end of the first recessed portion to a bottom end of the first recessed portion, so that a depth of the first recessed portion is gradually decreased in a radial-inward direction from the bottom end of the first recessed portion.

9. The acceleration device according to claim 1, wherein a first accommodating space is formed at the inner wall surface of the supporting body, so that the first accommodating space accommodates a part or a whole of a broken piece including the pedal-side biasing-member holding portion when the pedal-side biasing-member holding portion is broken away from the pedal-side boss portion at the mechanically-weaker portion.

10. The acceleration device according to claim 9, wherein a gap is formed between the pedal-side boss portion and the pedal-side biasing-member holding portion so that the pedal-side boss portion is rotatable, when the pedal-side biasing-member holding portion is broken away from the pedal-side boss portion and the part or the whole of the broken piece is accommodated in the first accommodating space.

11. The acceleration device according to claim 9, wherein a radial-inner side contacting surface of the first accommodating space is inclined from an open end of the first accommodating space to a bottom end of the first accommodating space, so that a depth of the first accommodating space is gradually increased in a radial-outward direction in an area of the radial-inner side contacting surface.

12. The acceleration device according to claim 1, wherein the second engaging portion is radially outward of the mechanically-weaker portion with respect to rotation around the pedal shaft.

13. The acceleration device according to claim 1, wherein the second engaging portion does not engage with the first engaging portion unless the pedal-side biasing-member holding portion is broken away from the pedal-side boss portion.

14. An acceleration device for an automotive vehicle comprising:

a supporting body to be fixed to a vehicle body;

a pedal shaft rotatably supported by the supporting body;

a rotating member provided at a radial-outer side of the pedal shaft and rotatable in accordance with rotation of the pedal shaft;

a biasing member for biasing the rotating member in a pedal closing direction;

an acceleration pedal to be operated by a vehicle driver;

a pedal arm connected at its one end to the acceleration pedal and converting a stepping movement of the acceleration pedal by the vehicle driver into a rotational torque of the pedal shaft; and a rotational angle detecting unit for detecting a rotational angle of the pedal shaft with respect to the supporting body, wherein the rotating member comprises;

a boss portion formed at the radial-outer side of the pedal shaft;

a biasing-member holding portion extending from the boss portion in a radial-outward direction of the pedal shaft for holding one end of the biasing member; and a mechanically-weaker portion formed between the boss portion and the biasing-member holding portion, wherein the boss portion, the biasing-member holding portion and the mechanically-weaker portion are integrally formed as one unit;

the biasing-member holding portion is configured to be broken away from the boss portion at the mechanically-weaker portion as a result of an acting force larger than a predetermined value in the pedal closing direction being applied to the rotating member;

the rotating member is composed of a pedal-side rotating member to be rotated together with the pedal shaft;

the biasing member is composed of a pedal-side biasing member for biasing the pedal-side rotating member in the pedal closing direction;

the boss portion is composed of a pedal-side boss portion to be fixed to an outer periphery of the pedal shaft;

the biasing-member holding portion is composed of a pedal-side biasing-member holding portion for holding one end of the pedal-side biasing member;

the pedal-side rotating member has a stopper arm extending from the pedal-side biasing-member holding portion in the radial-outward direction opposite to the pedal-side boss portion, the stopper arm being configured to contact with an inner wall surface of the supporting body due to movement of the acceleration pedal to an acceleration fully-closed position;

the pedal-side biasing-member holding portion is configured to be broken away from the pedal-side boss portion at the mechanically-weaker portion as a result of the acting force larger than the predetermined value in the pedal closing direction being applied to the pedal-side rotating member; and the following expression is satisfied:

$$Z1<Z2\times(L1/L2)$$

wherein

Z1 is a modulus of section of the mechanically-weaker portion;

Z2 is a modulus of section of any arbitrary portion, which is any portion of the pedal-side rotating member between the mechanically-weaker portion and the stopper arm;

L1 is a distance between a contacting point and a mechanically weak point, wherein the contacting point corresponds to a point of the stopper arm to be in contact with the inner wall surface of the supporting body and the mechanically weak point corresponds to a point of the mechanically-weaker portion facing to the inner wall surface of the supporting body; and L2 is a distance between the contacting point and an arbitrary point, wherein the arbitrary point corresponds to a point of the arbitrary portion facing to the inner wall surface of the supporting body.

* * * * *